US009097422B2

(12) United States Patent
Deng

(10) Patent No.: US 9,097,422 B2
(45) Date of Patent: Aug. 4, 2015

(54) CONTROL VALVES FOR HEATERS AND FIREPLACE DEVICES

(71) Applicant: PROCOM HEATING, INC., Brea, CA (US)

(72) Inventor: David Deng, Diamond Bar, CA (US)

(73) Assignee: PROCOM HEATING, INC., Brea, CA (US)

( * ) Notice: Subject to any disclaimer, the term of this patent is extended or adjusted under 35 U.S.C. 154(b) by 97 days.

(21) Appl. No.: 13/683,855

(22) Filed: Nov. 21, 2012

(65) Prior Publication Data

US 2013/0209944 A1 Aug. 15, 2013

Related U.S. Application Data

(63) Continuation of application No. 12/644,997, filed on Dec. 22, 2009, now Pat. No. 8,317,511, which is a continuation of application No. 11/943,359, filed on Nov. 20, 2007, now Pat. No. 7,654,820.

(60) Provisional application No. 60/871,760, filed on Dec. 22, 2006, provisional application No. 60/895,130, filed on Mar. 15, 2007.

(51) Int. Cl.
*F23D 11/42* (2006.01)
*F23N 1/00* (2006.01)
(Continued)

(52) U.S. Cl.
CPC ..... *F23N 1/002* (2013.01); *F23N 1/005* (2013.01); *F23N 5/105* (2013.01); *F23N 5/245* (2013.01);
(Continued)

(58) Field of Classification Search
CPC ..... F23Q 9/10; F23Q 9/08; F23N 1/002; F23N 1/005; F23N 5/245; F24C 3/10; F24C 3/103; F24C 5/14; F23D 5/16
USPC ..... 431/74, 6, 66, 47, 72, 86, 127, 128, 431/254; 137/625.15, 625.47, 905, 613; 236/1 A, 11, 15 BD
See application file for complete search history.

(56) References Cited

U.S. PATENT DOCUMENTS 743,714 A 11/1903 Guese
1,639,780 A 8/1927 Mulholland
(Continued)

FOREIGN PATENT DOCUMENTS

DE 720 854 C 5/1942
JP 58 219320 A 12/1983
(Continued)

OTHER PUBLICATIONS

Extended European Search Report for European Application No. 07024044.5 dated Jun. 28, 2013.
(Continued)

*Primary Examiner* — Gregory Huson
*Assistant Examiner* — Daniel E Namay
(74) *Attorney, Agent, or Firm* — Knobbe Martens Olson & Bear LLP

(57) ABSTRACT

A heating apparatus may include a control valve assembly. A control valve assembly can have a housing and a valve body positioned within the housing. The housing can define an inlet and first and second outlets. The control valve assembly can also include an igniter having a sensor for firing an electrode. An extension can be used to activate the sensor and to thereby activate the igniter.

19 Claims, 25 Drawing Sheets

(51) Int. Cl.

| | |
|---|---|
| ***F23Q 9/10*** | (2006.01) |
| ***F23N 5/24*** | (2006.01) |
| ***F23N 5/10*** | (2006.01) |
| ***F23N 5/26*** | (2006.01) |
| ***F23Q 9/00*** | (2006.01) |
| ***F23Q 21/00*** | (2006.01) |
| *F23D 5/16* | (2006.01) |
| *F23K 5/16* | (2006.01) |
| *F24C 3/10* | (2006.01) |

(52) U.S. Cl.

CPC .. *F23N 5/26* (2013.01); *F23Q 9/00* (2013.01); *F23Q 9/10* (2013.01); *F23Q 21/00* (2013.01); *F23N 2035/16* (2013.01); *F23N 2035/18* (2013.01); *F23N 2035/22* (2013.01); *F23N 2035/24* (2013.01)

(56) References Cited

U.S. PATENT DOCUMENTS

| | | | | |
|---|---|---|---|---|
| 2,422,368 | A | | 6/1947 | Ray |
| 2,556,337 | A | | 6/1951 | Paille |
| 2,870,835 | A | * | 1/1959 | Lundgren ..... 431/46 |
| 3,139,879 | A | | 7/1964 | Bauer et al. |
| 3,430,655 | A | | 3/1969 | Forney |
| 3,537,473 | A | * | 11/1970 | Dezurik, Jr. ..... 137/556.6 |
| 3,590,806 | A | | 7/1971 | Locke |
| 3,814,573 | A | | 6/1974 | Karlovetz |
| 3,939,871 | A | | 2/1976 | Dickson |
| 3,954,384 | A | * | 5/1976 | Tyler ..... 431/47 |
| D243,694 | S | | 3/1977 | Faulkner |
| 4,021,190 | A | | 5/1977 | Dickson |
| 4,081,235 | A | | 3/1978 | van der Veer |
| 4,340,362 | A | | 7/1982 | Chalupsky et al. |
| 4,348,172 | A | | 9/1982 | Miller |
| 4,384,705 | A | * | 5/1983 | Kato ..... 251/214 |
| 4,640,680 | A | | 2/1987 | Schilling |
| 4,718,846 | A | | 1/1988 | Oguri et al. |
| 4,768,947 | A | | 9/1988 | Adachi |
| 4,782,814 | A | | 11/1988 | Cherryholmes |
| 4,848,313 | A | | 7/1989 | Velie |
| 4,965,707 | A | | 10/1990 | Butterfield |
| 5,090,899 | A | | 2/1992 | Kee |
| 5,239,979 | A | | 8/1993 | Maurice et al. |
| 5,251,823 | A | | 10/1993 | Joshi et al. |
| 5,375,585 | A | * | 12/1994 | Home ..... 126/39 E |
| 5,413,141 | A | | 5/1995 | Dietiker |
| 5,470,018 | A | | 11/1995 | Smith |
| 5,513,798 | A | | 5/1996 | Tavor |
| 5,542,609 | A | | 8/1996 | Myers et al. |
| 5,567,141 | A | | 10/1996 | Joshi et al. |
| 5,584,680 | A | | 12/1996 | Kim |
| 5,603,211 | A | | 2/1997 | Graves |
| 5,642,580 | A | | 7/1997 | Hess et al. |
| 5,645,043 | A | | 7/1997 | Long et al. |
| D391,345 | S | | 2/1998 | Mandir et al. |
| 5,782,626 | A | | 7/1998 | Joos et al. |
| 5,787,874 | A | | 8/1998 | Krohn et al. |
| 5,787,928 | A | | 8/1998 | Allen et al. |
| 5,814,121 | A | | 9/1998 | Travis |
| 5,838,243 | A | | 11/1998 | Gallo |
| 5,915,952 | A | | 6/1999 | Manning et al. |
| 5,941,699 | A | | 8/1999 | Abele |
| 5,966,937 | A | | 10/1999 | Graves |
| 5,987,889 | A | | 11/1999 | Graves et al. |
| 6,045,058 | A | | 4/2000 | Dobbeling et al. |
| 6,076,517 | A | | 6/2000 | Kahlke et al. |
| 6,227,451 | B1 | | 5/2001 | Caruso |
| 6,244,524 | B1 | | 6/2001 | Tackels et al. |
| 6,340,298 | B1 | | 1/2002 | Vandrak et al. |
| 6,352,428 | B1 | | 3/2002 | Uribetxebarria et al. |
| 6,354,072 | B1 | | 3/2002 | Hura |
| RE37,617 | E | * | 4/2002 | Sherman ..... 137/557 |
| 6,543,235 | B1 | | 4/2003 | Black et al. |
| 6,648,635 | B2 | | 11/2003 | Vandrak et al. |
| 6,884,065 | B2 | | 4/2005 | Vandrak et al. |
| 6,901,962 | B2 | | 6/2005 | Kroupa et al. |
| 6,904,873 | B1 | | 6/2005 | Ashton |
| 6,938,634 | B2 | | 9/2005 | Dewey, Jr. |
| 7,044,729 | B2 | | 5/2006 | Ayastuy et al. |
| 7,243,647 | B2 | * | 7/2007 | Pianezze ..... 126/39 E |
| 7,251,940 | B2 | | 8/2007 | Graves et al. |
| 7,607,426 | B2 | | 10/2009 | Deng |
| 7,654,820 | B2 | | 2/2010 | Deng |
| 2002/0058266 | A1 | | 5/2002 | Clough et al. |
| 2005/0161518 | A1 | * | 7/2005 | Munsterhuis ..... 236/26 A |
| 2007/0044856 | A1 | | 3/2007 | Bonior |
| 2013/0209944 | A1 | * | 8/2013 | Deng ..... 431/6 |

FOREIGN PATENT DOCUMENTS

| | | | | |
|---|---|---|---|---|
| JP | 03 230015 | A | | 10/1991 |
| JP | 2003 056845 | A | | 2/2003 |
| JP | 2003 074837 | A | | 3/2003 |
| JP | 2003 074838 | A | | 3/2003 |
| JP | 2004-68911 | A | * | 3/2004 |
| WO | WO 94/01722 | | | 1/1994 |

OTHER PUBLICATIONS

Heat and Glo, Escape Series Gas Fireplaces, Mar. 2005.

Heat and Glo, Escape-42DV Owner's Manual, Rev. i, Dec. 2006.

International Search Report and Written Opinion for Application No. PCT-US2008-056910, mailed Jul. 16, 2008.

Napoleon, Park Avenue Installation and Operation Instructions, Jul. 20, 2006.

Napoleon, The Madison Installation and Operation Instructions, May 24, 2005.

* cited by examiner

CONTROL VALVES FOR HEATERS AND FIREPLACE DEVICES

CROSS-REFERENCE TO RELATED APPLICATIONS

This application is a continuation of U.S. application Ser. No. 12/644,997, filed Dec. 22, 2009, now U.S. Pat. No. 8,317,511, which is a continuation of U.S. application Ser. No. 11/943,359, filed Nov. 20, 2007, now U.S. Pat. No. 7,654,820, which claims the benefit under 35 U.S.C. §119(e) of U.S. Provisional Application No. 60/871,760, filed Dec. 22, 2006, and U.S. Provisional Application No. 60/895,130, filed Mar. 15, 2007. All of the above applications are hereby incorporated herein by reference in their entirety and are to be considered part of this application.

BACKGROUND

1. Field of the Inventions

Certain embodiments disclosed herein relate generally to heating devices, and relate more specifically to fluid-fueled heating devices.

2. Description of the Related Art

Many varieties of heaters, fireplaces, stoves, and other heating devices utilize pressurized, combustible fuels. Some such devices can include control valves that regulate fluid flow through the devices. However, such control valves have various limitations and disadvantages.

SUMMARY OF THE INVENTIONS

In certain embodiments, a control valve assembly for gas heaters and gas fireplace devices includes a housing. The housing can define an inlet for accepting fuel from a fuel source, a first outlet for delivering fuel to an oxygen depletion sensor, and a second outlet for delivering fuel to a burner. The assembly can include a valve body configured to selectively provide fluid communication between the inlet and one or more of the first outlet and the second outlet, and can include an actuator configured to move the valve body relative to the housing. The actuator can be configured to transition between a resting state and a displaced state. The assembly can include an igniter that includes a sensor, the igniter electrically coupled with an electrode and configured to repeatedly activate the electrode when the sensor senses that the actuator is in the displaced state. The assembly can include a shutoff valve electrically coupled with the oxygen depletion sensor and configured to operate in response to an electrical quantity communicated by the oxygen depletion sensor.

In some embodiments, a control valve assembly for gas heaters, gas log inserts and gas fireplaces includes a housing. The housing can define an inlet for accepting fuel from a fuel source, a first outlet for delivering fuel to an oxygen depletion sensor, and a second outlet for delivering fuel to a burner. The housing can further define a first fuel path in fluid communication with the second outlet and a second fuel path in fluid communication with the second outlet. The assembly can include a valve body configured to selectively provide fluid communication between the inlet and one or more of the first outlet and the second outlet. The valve body can be configured to provide fluid communication between the inlet and the second outlet via either the first fuel path or the second fuel path. The assembly can include a first shutoff valve electrically coupled with the oxygen depletion sensor and configured to operate in response to an electrical quantity communicated by the oxygen depletion sensor. The assembly can also include a second shutoff valve configured to selectively prevent fluid communication between the valve body and the second outlet via the first fuel path.

A dual fuel heating apparatus can include a safety control system. The safety control system can comprise a shutoff valve, a thermocouple solenoid assembly, a first igniter, a first nozzle, a second nozzle, a fluid flow controller, a burner, and at least one burner nozzle. The first igniter can be configured to instigate combustion of a first gas, liquid, or combination thereof or combustion of a second gas, liquid, or combination thereof, the first gas, liquid, or combination thereof being different from the second gas, liquid, or combination thereof. The first nozzle can have a first air inlet aperture. The first nozzle can be positioned to direct heat from combustion of the first gas, liquid, or combination thereof towards the thermocouple solenoid assembly when the first gas, liquid, or combination thereof is being combusted. The second nozzle can have a second air inlet aperture larger than the first air inlet aperture. The second nozzle can be positioned to direct heat from combustion of the second gas, liquid, or combination thereof towards the thermocouple solenoid assembly when the second gas, liquid, or combination thereof is being combusted. The shutoff valve can be at least indirectly fluidly connected to at least one of the first nozzle and the second nozzle. The thermocouple solenoid assembly can be configured to maintain the shutoff valve in an open position based on heat from combustion directed to the thermocouple solenoid assembly. The thermocouple solenoid assembly can also be configured to maintain the shutoff valve in a closed position based on an absence of heat from combustion directed to the thermocouple solenoid assembly. The at least one burner nozzle can direct the first gas, liquid, or combination thereof or the second gas, liquid, or combination thereof to the burner. Either the first or the second gas, liquid, or combination thereof can be directed from the shutoff valve to the fluid flow controller and from the fluid flow controller to the at least one burner nozzle.

BRIEF DESCRIPTION OF THE DRAWINGS

Various embodiments are depicted in the accompanying drawings for illustrative purposes, and should in no way be interpreted as limiting the scope of the inventions.

DETAILED DESCRIPTION OF THE PREFERRED EMBODIMENTS

Many varieties of space heaters, fireplaces, stoves, fireplace inserts, gas logs, and other heat-producing devices employ combustible fuels, such as liquid propane and natural gas. These devices generally are designed to operate with a single fuel type at a specific pressure. For example, some gas heaters that are configured to be installed on a wall or a floor operate with natural gas at a pressure in a range from about 3 inches of water column to about 6 inches of water column, while others operate with liquid propane at a pressure in a range from about 8 inches of water column to about 12 inches of water column.

In many instances, the operability of such devices with only a single fuel source is disadvantageous for distributors, retailers, and/or consumers. For example, retail stores often try to predict the demand for natural gas units versus liquid propane units over a given winter season, and accordingly stock their shelves and/or warehouses with a percentage of each variety of heating unit. Should such predictions prove incorrect, stores can be left with unsold units when the demand for one type of heater was less than expected, while some potential customers can be left waiting through shipping delays or even be turned away empty-handed when the demand for one type of heater was greater than expected. Either case can result in financial and other costs to the stores. Additionally, some consumers can be disappointed to discover that the styles or models of stoves or fireplaces with which they wish to improve their homes are incompatible with the fuel sources with which their homes are serviced.

Certain advantageous embodiments disclosed herein reduce or eliminate these and other problems associated with heating devices that operate with only a single type of fuel source. Furthermore, although the embodiments described hereafter are presented in the context of vent-free heating systems, the apparatus and devices disclosed and enabled herein can benefit a wide variety of other applications.

Figure 1:
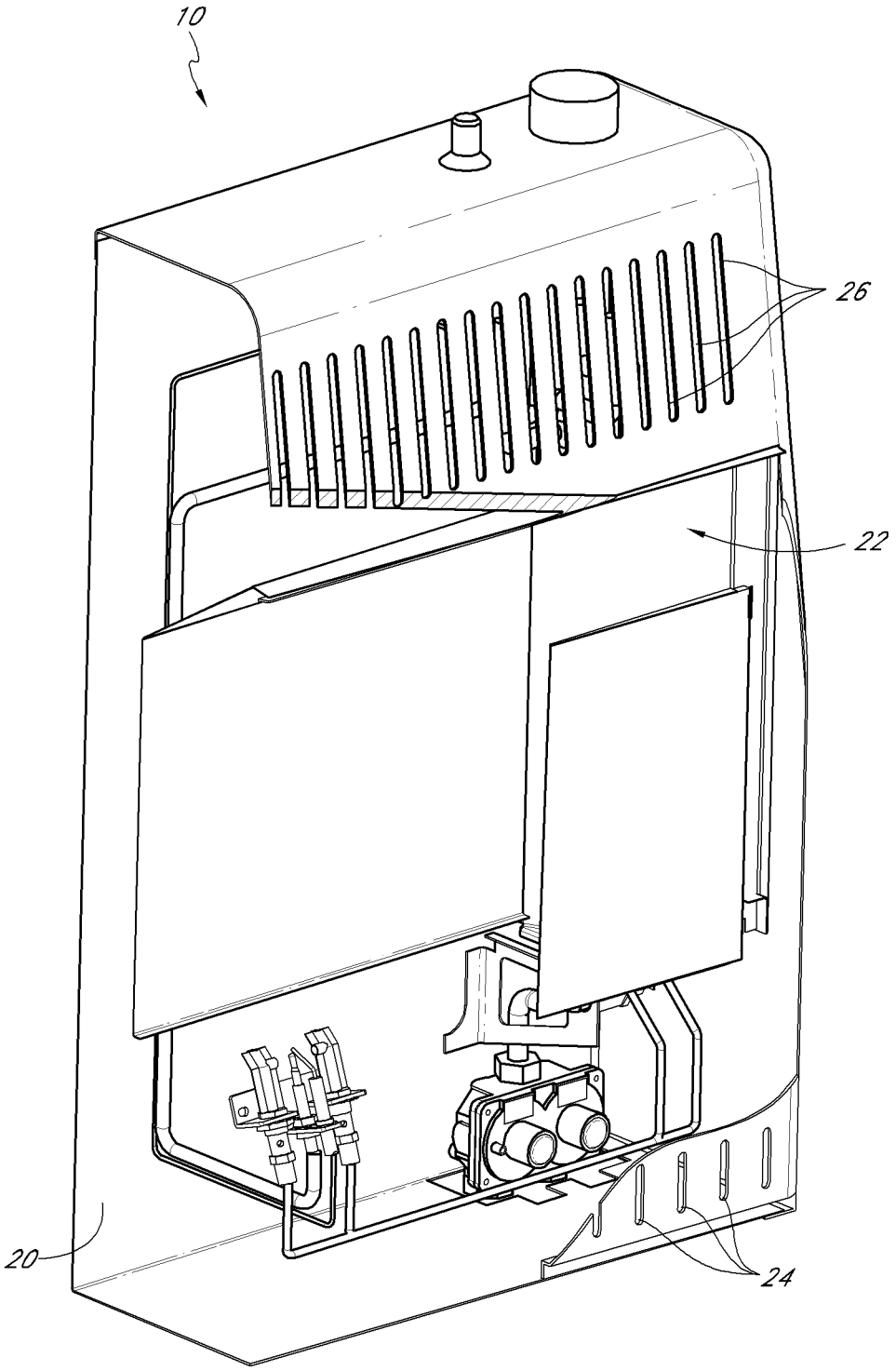
FIG. 1 is a perspective cutaway view of a portion of an embodiment of a heater configured to operate using either a first fuel source or a second fuel source.

FIG. 1 illustrates one embodiment of a heater 10. In various embodiments, the heater 10 is a vent-free infrared heater, a vent-free blue flame heater, or some other variety of heater, such as a direct vent heater. Some embodiments include stoves, fireplaces, and gas logs. Other configurations are also possible for the heater 10. In many embodiments, the heater 10 is configured to be mounted to a wall or a floor or to otherwise rest in a substantially static position. In other embodiments, the heater 10 is configured to move within a limited range. In still other embodiments, the heater 10 is portable.

In certain embodiments, the heater 10 comprises a housing 20. The housing 20 can include metal or some other suitable material for providing structure to the heater 10 without melting or otherwise deforming in a heated environment. In some embodiments, the housing 20 comprises a window 22 through which heated air and/or radiant energy can pass. In further embodiments, the housing 20 comprises one or more intake vents 24 through which air can flow into the heater 10. In some embodiments, the frame comprises outlet vents 26 through which heated air can flow out of the heater 10.

Figure 2:
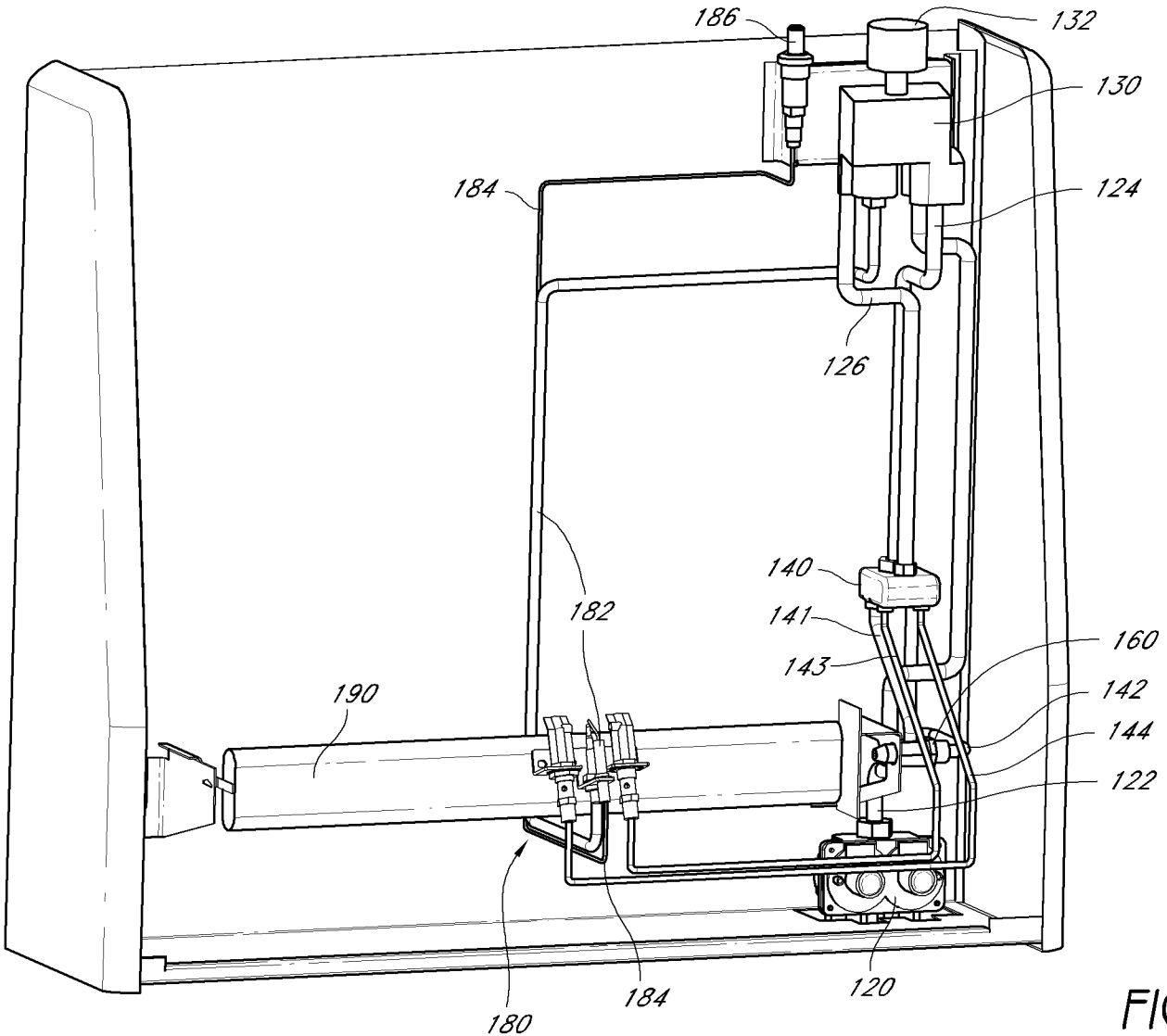
FIG. 2 is a perspective cutaway view of the heater of FIG. 1.
Figure 3:
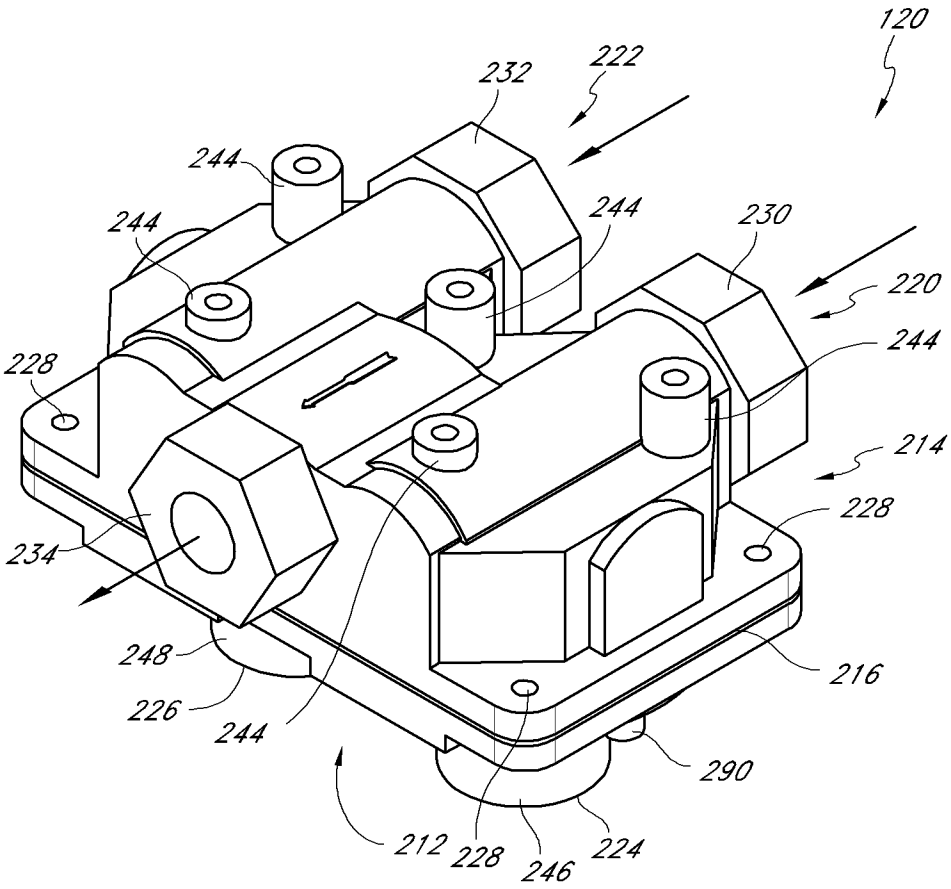
FIG. 3 is a bottom perspective view of an embodiment of a pressure regulator configured to couple with either the first fuel source or the second fuel source.
Figure 4:
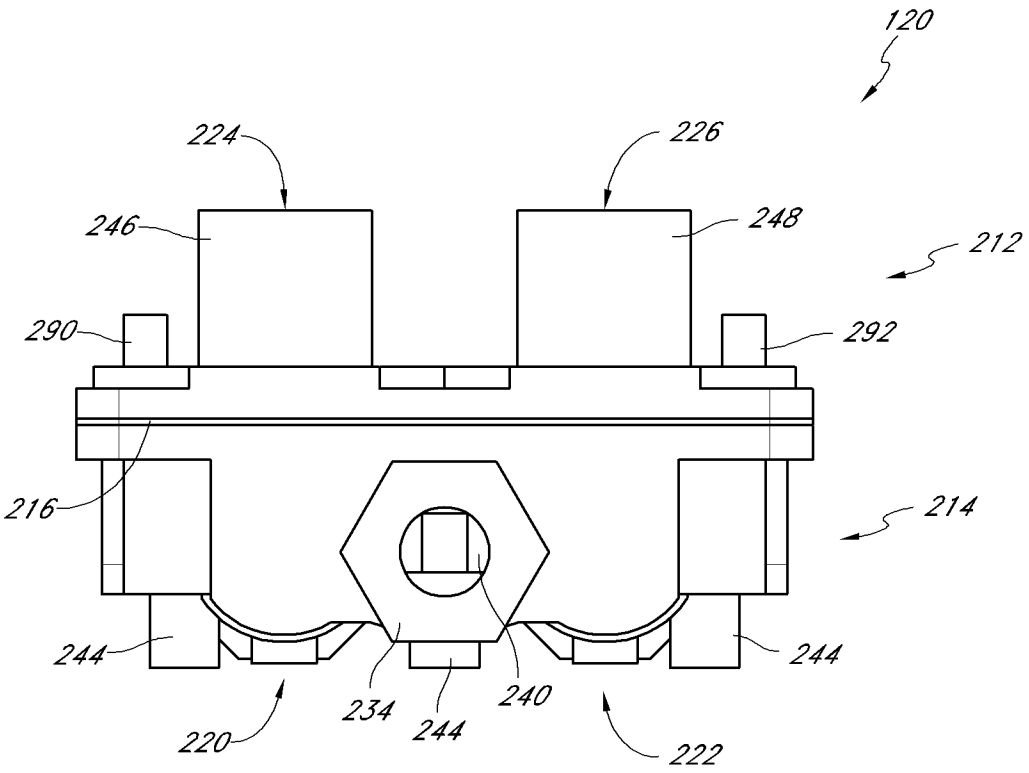
FIG. 4 is a back elevation view of the pressure regulator of FIG. 3.
Figure 5:
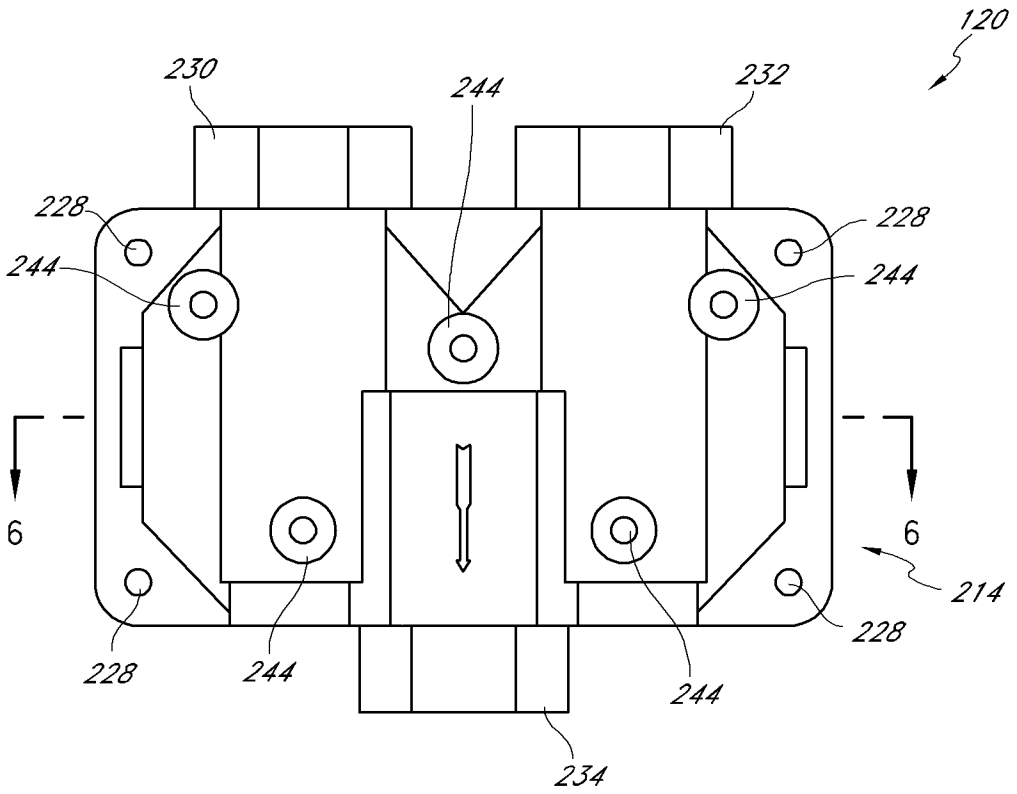
FIG. 5 is a bottom plan view of the pressure regulator of FIG. 3.
Figure 6:
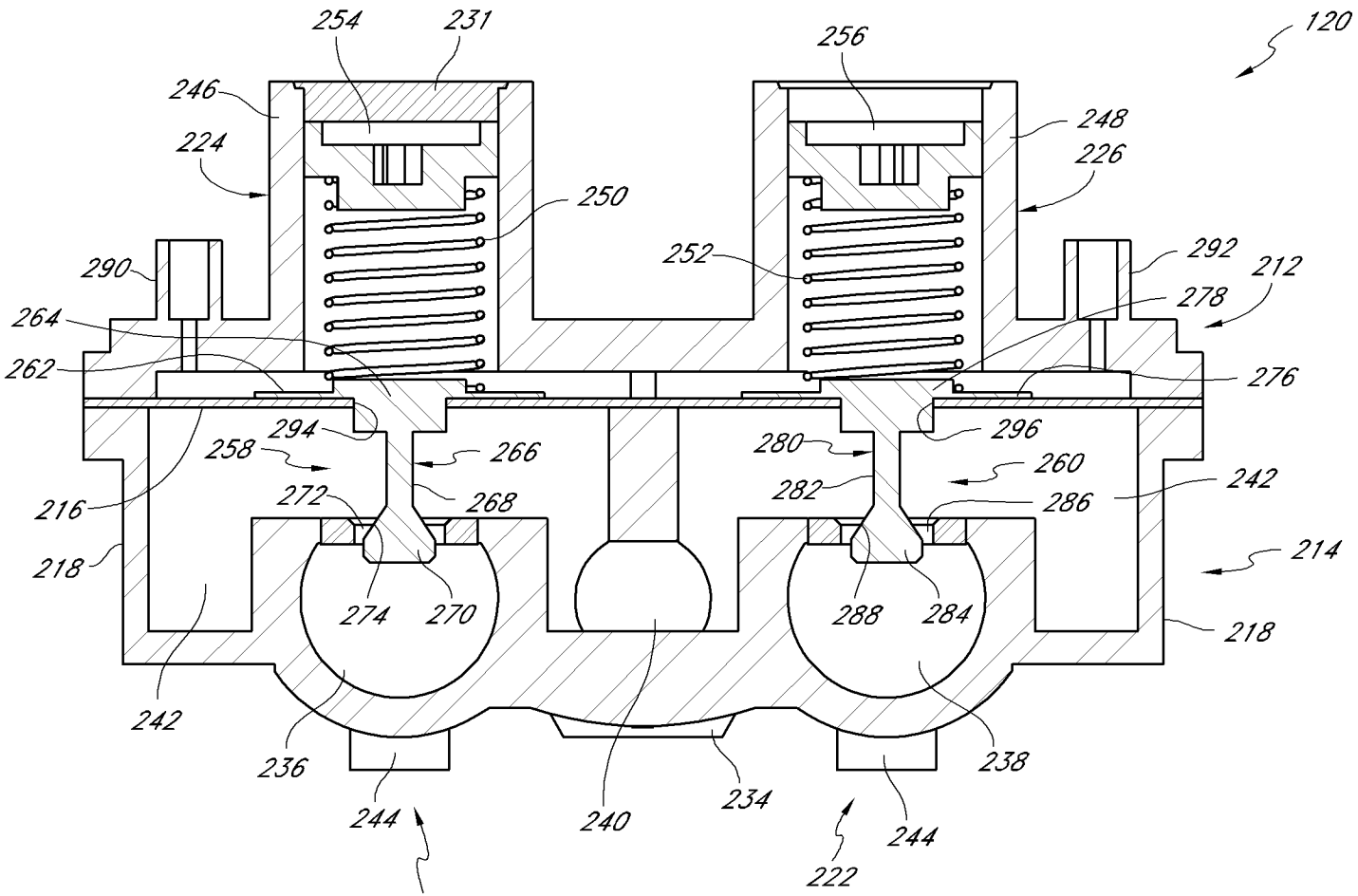
FIG. 6 is a cross-sectional view of the pressure regulator of FIG. 3 taken along the line 6-6 in FIG. 5.
Figure 7:
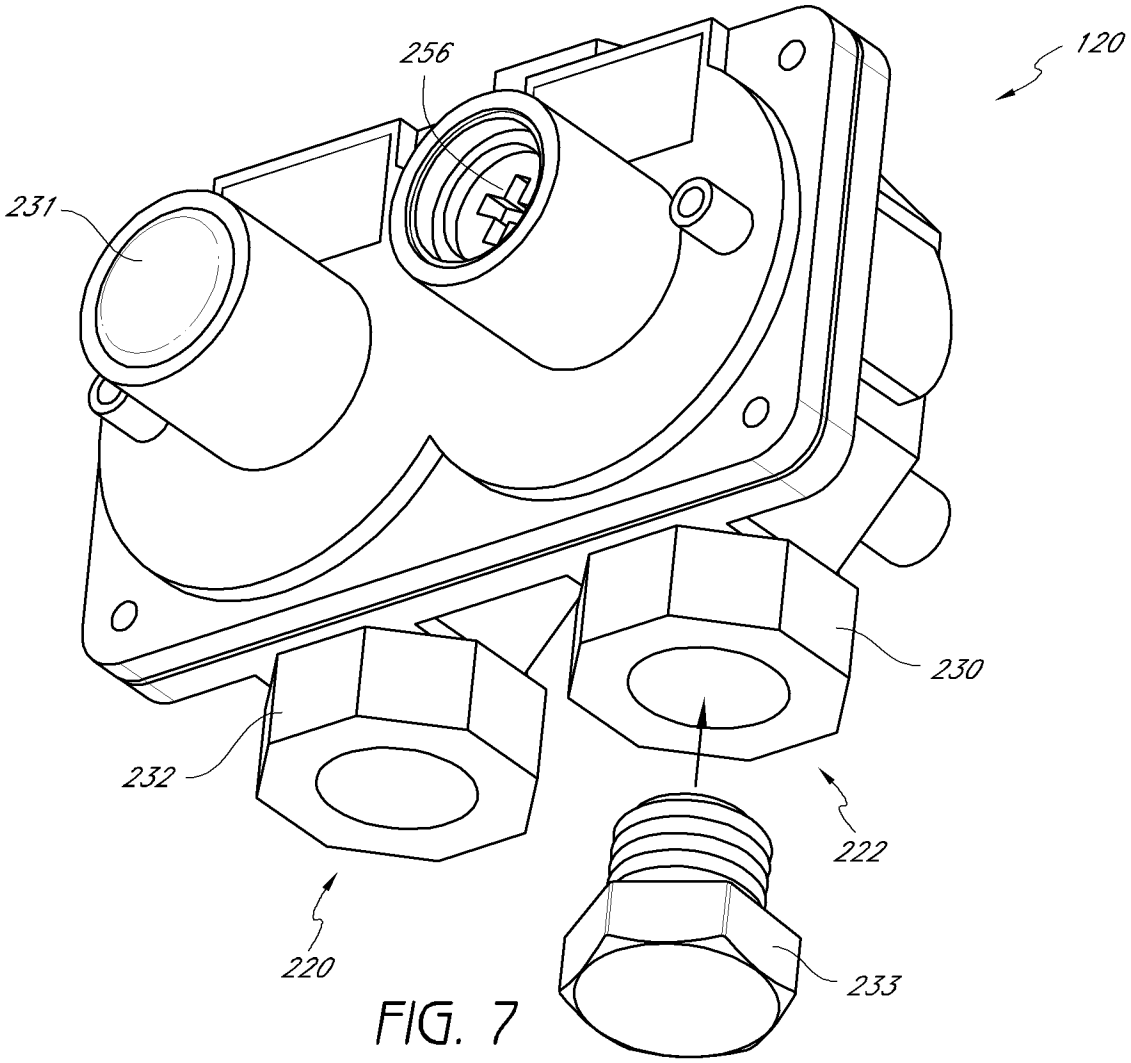
FIG. 7 is a top perspective view of the pressure regulator of FIG. 3.

With reference to FIG. 2, in certain embodiments, the heater 10 includes a regulator 120. In some embodiments, the regulator 120 is coupled with an output line or intake line, conduit, or pipe 122. The intake pipe 122 can be coupled with a heater control valve 130, which, in some embodiments, includes a knob 132. In many embodiments, the heater control valve 130 is coupled to a fuel supply pipe 124 and a pilot pipe or oxygen depletion sensor (ODS) pipe 126, each of which can be coupled with a fluid flow controller 140. In some embodiments, the fluid flow controller 140 is coupled with a first nozzle line 141, a second nozzle line 142, a first ODS line 143, and a second ODS line 144. In some embodiments, the first and the second nozzle lines 141, 142 are coupled with a nozzle 160, and the first and the second ODS lines 143, 144 are coupled with a pilot assembly, such an ODS 180. In some embodiments, the ODS comprises a thermocouple 182, which can be coupled with the heater control valve 130, and an igniter line 184, which can be coupled with an igniter switch 186. Each of the pipes 122, 124, and 126 and the lines 141-144 can define a fluid passageway or flow channel through which a fluid can move or flow.

In some embodiments, the heater 10 comprises a combustion chamber 190. In some embodiments, the ODS 180 is mounted to the combustion chamber 190, as shown in the illustrated embodiment. In further embodiments, the nozzle 160 is positioned to discharge a fluid, which may be a gas, liquid, or combination thereof into the combustion chamber 190. For purposes of brevity, recitation of the term "gas or liquid" hereafter shall also include the possibility of a combination of a gas and a liquid. In addition, as used herein, the term "fluid" is a broad term used in its ordinary sense, and includes materials or substances capable of fluid flow, such as gases, liquids, and combinations thereof.

In certain preferred embodiments, either a first or a second fluid is introduced into the heater 10 through the regulator 120. In certain embodiments, the first or the second fluid proceeds from the regulator 120 through the intake pipe 122 to the heater control valve 130. In some embodiments, the heater control valve 130 can permit a portion of the first or the second fluid to flow into the fuel supply pipe 124 and permit another portion of the first or the second fluid to flow into the ODS pipe 126, as described in further detail below.

In certain embodiments, the first or the second fluid can proceed to the fluid flow controller 140. In many embodiments, the fluid flow controller 140 is configured to channel the respective portions of the first fluid from the fuel supply pipe 124 to the first nozzle line 141 and from the ODS pipe 126 to the first ODS line 143 when the fluid flow controller 140 is in a first state, and is configured to channel the respective portions of the second fluid from the fuel supply pipe 124 to the second nozzle line 142 and from the ODS pipe 126 to the second ODS line 144 when the fluid flow controller 140 is in a second state.

In certain embodiments, when the fluid flow controller 140 is in the first state, a portion of the first fluid proceeds through the first nozzle line 141, through the nozzle 160 and is delivered to the combustion chamber 190, and a portion of the first fluid proceeds through the first ODS line 143 to the ODS 180. Similarly, when the fluid flow controller 140 is in the second state, a portion of the second fluid proceeds through the nozzle 160 and another portion proceeds to the ODS 180. As discussed in more detail below, other configurations are also possible.

With reference to FIGS. 3-7, certain embodiments of the pressure regulator 120 will now be described. FIGS. 3-7 depict different views of one embodiment of the pressure regulator 120. The regulator 120 desirably provides an adaptable and versatile system and mechanism which allows at least two fuel sources to be selectively and independently utilized with the heater 10. In some embodiments, the fuel sources comprise natural gas and propane, which in some instances can be provided by a utility company or distributed in portable tanks or vessels.

In certain embodiments, the heater 10 and/or the regulator 120 are preset at the manufacturing site, factory, or retailer to operate with selected fuel sources. As discussed below, in many embodiments, the regulator 120 includes one or more caps 231 to prevent consumers from altering the pressure settings selected by the manufacturer. Optionally, the heater 10 and/or the regulator 120 can be configured to allow an installation technician and/or user or customer to adjust the heater 10 and/or the regulator 120 to selectively regulate the heater unit for a particular fuel source.

In many embodiments, the regulator 120 comprises a first, upper, or top portion or section 212 sealingly engaged with a second, lower, or bottom portion or section 214. In some embodiments, a flexible diaphragm 216 or the like is positioned generally between the two portions 212, 214 to provide a substantially airtight engagement and generally define a housing or body portion 218 of the second portion 212 with the housing 218 also being sealed from the first portion 212. In some embodiments, the regulator 120 comprises more than one diaphragm 216 for the same purpose.

In certain embodiments, the first and second portions 212, 214 and diaphragm 216 comprise a plurality of holes or passages 228. In some embodiments, a number of the passages 228 are aligned to receive a pin, bolt, screw, or other fastener to securely and sealingly fasten together the first and second portions 212, 214. Other fasteners such as, but not limited to, clamps, locks, rivet assemblies, or adhesives may be efficaciously used.

In some embodiments, the regulator 120 comprises two selectively and independently operable pressure regulators or actuators 220 and 222 which are independently operated depending on the fuel source, such as, but not limited to, natural gas and propane. In some embodiments, the first pressure regulator 220 comprises a first spring-loaded valve or valve assembly 224 and the second pressure regulator 222 comprises a second spring-loaded valve or valve assembly 226.

In certain embodiments, the second portion 214 comprises a first fluid opening, connector, coupler, port, or inlet 230 configured to be coupled to a first fuel source. In further embodiments, the second portion 214 comprises a second fluid opening, connector, coupler, port, or inlet 232 configured to be coupled to a second fuel source. In some embodiments, the second connector 232 is threaded. In some embodiments, the first connector 230 and/or the first fuel source comprises liquid propane and the second fuel source comprises natural gas, or vice versa. The fuel sources can efficaciously comprise a gas, a liquid, or a combination thereof.

In certain embodiments, the second portion 214 further comprises a third fluid opening, connector, port, or outlet 234 configured to be coupled with the intake pipe 122 of the heater 10. In some embodiments, the connector 234 comprises threads for engaging the intake pipe 122. Other connection interfaces may also be used.

In some embodiments, the housing 218 of the second portion 214 defines at least a portion of a first input channel or passage 236, a second input channel or passage 238, and an output channel or passage 240. In many embodiments, the first input channel 236 is in fluid communication with the first connector 230, the second input channel 238 is in fluid communication with the second connector 232, and the output channel 240 is in fluid communication with the third connector 234.

In certain embodiments, the output channel 240 is in fluid communication with a chamber 242 of the housing 218 and the intake pipe 122 of the heater 10. In some embodiments, the input channels 236, 238 are selectively and independently in fluid communication with the chamber 242 and a fuel source depending on the particular fuel being utilized for heating.

In one embodiment, when the fuel comprises natural gas, the second input connector 232 is sealingly plugged by a plug or cap 233 (see FIG. 7) while the first input connector 230 is connected to and in fluid communication with a fuel source that provides natural gas for combustion and heating. In certain embodiments, the cap 233 comprises threads or some other suitable fastening interface for engaging the connector 232. The natural gas flows in through the first input channel 236 into the chamber 242 and out of the chamber 242 through the output channel 240 and into the intake pipe 122 of the heater 10.

In another embodiment, when the fuel comprises propane, the first input connector 230 is sealingly plugged by the plug or cap 233 while the second input connector 232 is connected to and in fluid communication with a fuel source that provides propane for combustion and heating. The propane flows in through the second input channel 238 into the chamber 242 and out of the chamber 242 through the output channel 240 and into the intake pipe 122 of the heater 10. As one having skill in the art would appreciate, when the cap 233 is coupled with either the first input connector 230 or the second input connector 232 prior to packaging or shipment of the heater 10, it can have the added advantage of helping consumers distinguish the first input connector 230 from the second input connector 232.

In some embodiments, the regulator 120 comprises a single input connector that leads to the first input channel 236 and the second input channel 238. In certain of such embodiments, either a first pressurized source of liquid or gas or a second pressurized source of liquid or gas can be coupled with the same input connector. In certain of such embodiments, a valve or other device is employed to seal one of the first input channel 236 or the second input channel 238 while leaving the remaining desired input channel 236, 238 open for fluid flow.

In certain embodiments, the second portion 214 comprises a plurality of connection or mounting members or elements 244 that facilitate mounting of the regulator 120 to a suitable surface of the heater 10. The connection members 244 can comprise threads or other suitable interfaces for engaging pins, bolts, screws, or other fasteners to securely mount the regulator 120. Other connectors or connecting devices such as, but not limited to, clamps, locks, rivet assemblies, and adhesives may be efficaciously used, as needed or desired.

In certain embodiments, the first portion 212 comprises a first bonnet 246, a second bonnet 248, a first spring or resilient biasing member 250 positioned in the bonnet 246, a second spring or resilient biasing member 252 positioned in the bonnet 248, a first pressure adjusting or tensioning screw 254 for tensioning the spring 250, a second pressure adjusting or tensioning screw 256 for tensioning the spring 252 and first and second plunger assemblies 258 and 260 which extend into the housing 218 of the second portion 214. In some embodiments, the springs 250, 252 comprise steel wire. In some embodiments, at least one of the pressure adjusting or tensioning screws 254, 256 may be tensioned to regulate the pressure of the incoming fuel depending on whether the first or second fuel source is utilized. In some embodiments, the appropriate pressure adjusting or tensioning screws 254, 256 are desirably tensioned by a predetermined amount at the factory or manufacturing facility to provide a preset pressure or pressure range. In other embodiments, this may be accomplished by a technician who installs the heater 10. In many embodiments, caps 231 are placed over the screws 254, 256 to prevent consumers from altering the preset pressure settings.

In certain embodiments, the first plunger assembly 258 generally comprises a first diaphragm plate or seat 262 which seats the first spring 250, a first washer 264 and a movable first plunger or valve stem 266 that extends into the housing 218 of the second portion 214. The first plunger assembly 258 is configured to substantially sealingly engage the diaphragm 216 and extend through a first orifice 294 of the diaphragm 216.

In some embodiments, the first plunger 266 comprises a first shank 268 which terminates at a distal end as a first seat 270. The seat 270 is generally tapered or conical in shape and selectively engages a first O-ring or seal ring 272 to selectively substantially seal or allow the first fuel to flow through a first orifice 274 of the chamber 242 and/or the first input channel 236.

In certain embodiments, the tensioning of the first screw 254 allows for flow control of the first fuel at a predetermined first pressure or pressure range and selectively maintains the orifice 274 open so that the first fuel can flow into the chamber 242, into the output channel 240 and out of the outlet 234 and into the intake pipe 122 of the heater 10 for downstream combustion. If the first pressure exceeds a first threshold pressure, the first plunger seat 270 is pushed towards the first seal ring 272 and seals off the orifice 274, thereby terminating fluid communication between the first input channel 236 (and the first fuel source) and the chamber 242 of the housing 218.

In some embodiments, the first pressure or pressure range and the first threshold pressure are adjustable by the tensioning of the first screw 254. In certain embodiments, the pressure selected depends at least in part on the particular fuel used, and may desirably provide for safe and efficient fuel combustion and reduce, mitigate, or minimize undesirable emissions and pollution. In some embodiments, the first screw 254 may be tensioned to provide a first pressure in the range from about 3 inches of water column to about 6 inches of water column, including all values and sub-ranges therebetween. In some embodiments, the first threshold or flow-terminating pressure is about 3 inches of water column, about 4 inches of water column, about 5 inches of water column, or about 6 inches of water column. In certain embodiments, when the first inlet 230 and the first input channel 236 are being utilized to provide a given fuel, the second inlet 232 is plugged or substantially sealed.

In certain embodiments, the first pressure regulator 220 (and/or the first valve assembly 224) comprises a vent 290 or the like at the first portion 212. The vent can be substantially sealed, capped, or covered by a dustproof cap or cover, often for purposes of shipping. The cover is often removed prior to use of the regulator 120. In many embodiments, the vent 290 is in fluid communication with the bonnet 246 housing the spring 250 and may be used to vent undesirable pressure build-up and/or for cleaning or maintenance purposes.

In certain embodiments, the second plunger assembly 260 generally comprises a second diaphragm plate or seat 276 which seats the second spring 252, a second washer 278 and a movable second plunger or valve stem 280 that extends into the housing 218 of the second portion 214. The second plunger assembly 260 substantially sealingly engages the diaphragm 216 and extends through a second orifice 296 of the diaphragm 216.

In certain embodiments, the second plunger 280 comprises a second shank 282 which terminates at a distal end as a second seat 284. The seat 284 is generally tapered or conical in shape and selectively engages a second O-ring or seal ring 286 to selectively substantially seal or allow the second fuel to flow through a second orifice 288 of the chamber 242 and/or the second input channel 238.

In certain embodiments, the tensioning of the second screw 256 allows for flow control of the second fuel at a predetermined second pressure or pressure range and selectively maintains the orifice 288 open so that the second fuel can flow into the chamber 242, into the output channel 240 and out of the outlet 234 and into the intake pipe 122 of the heater 10 for downstream combustion. If the second pressure exceeds a second threshold pressure, the second plunger seat 284 is pushed towards the second seal ring 286 and seals off the orifice 288, thereby terminating fluid communication between the second input channel 238 (and the second fuel source) and the chamber 242 of the housing 218.

In certain embodiments, the second pressure or pressure range and the second threshold pressure are adjustable by the tensioning of the second screw 256. In some embodiments, the second screw 256 may be tensioned to provide a second pressure in the range from about 8 inches of water column to about 12 inches of water column, including all values and sub-ranges therebetween. In some embodiments, the second threshold or flow-terminating pressure is about equal to 8 inches of water column, about 9 inches of water column, about 10 inches of water column, about 11 inches of water column, or about 12 inches of water column. In certain embodiments, when the second inlet 232 and the second input channel 238 are being utilized to provide a given fuel, the first inlet 230 is plugged or substantially sealed.

In certain embodiments, the second pressure regulator 222 (and/or the second valve assembly 226) comprises a vent 292 or the like at the first portion 212. The vent can be substantially sealed, capped or covered by a dustproof cap or cover. The vent 292 is in fluid communication with the bonnet 248 housing the spring 252 and may be used to vent undesirable pressure build-up and/or for cleaning or maintenance purposes and the like.

In some embodiments, when natural gas is the first fuel and propane is the second fuel, the first pressure, pressure range and threshold pressure are less than the second pressure, pressure range and threshold pressure. Stated differently, in some embodiments, when natural gas is the first fuel and propane is the second fuel, the second pressure, pressure range and threshold pressure are greater than the first pressure, pressure range and threshold pressure.

Advantageously, the dual regulator 120, by comprising first and second pressure regulators 220, 222 and corresponding first and second valves or valve assemblies 224, 226, which are selectively and independently operable facilitates a single heater unit being efficaciously used with different fuel sources. This desirably saves on inventory costs, offers a retailer or store to stock and provide a single unit that is usable with more than one fuel source, and permits customers the convenience of readily obtaining a unit which operates with the fuel source of their choice. The particular fuel pressure operating range is desirably factory-preset to provide an adaptable and versatile heater.

The pressure regulating device 120 can comprise a wide variety of suitably durable materials. These include, but are not limited to, metals, alloys, ceramics, plastics, among others. In one embodiment, the pressure regulating device 120 comprises a metal or alloy such as aluminum or stainless steel. The diaphragm 216 can comprise a suitable durable flexible material, such as, but not limited to, various rubbers, including synthetic rubbers. Various suitable surface treatments and finishes may be applied with efficacy, as needed or desired.

In certain embodiments, the pressure regulating device 120 can be fabricated or created using a wide variety of manufacturing methods, techniques and procedures. These include, but are not limited to, casting, molding, machining, laser processing, milling, stamping, laminating, bonding, welding, and adhesively fixing, among others.

Although the regulator 120 has been described as being integrated in the heater 10, the regulator 120 is not limited to use with heating devices, and can benefit various other applications. Additionally, pressure ranges and/or fuel-types that are disclosed with respect to one portion of the regulator 120 can also apply to another portion of the regulator 120. For example, tensioning of either the first screw 254 or the second screw 256 can result in pressure ranges between about 3 inches of water column and about 6 inches of water column or between about 8 inches of water column and about 12 inches of water column, in some embodiments.

As noted above, in certain embodiments, the regulator 120 is configured to allow passage therethrough of either a first or a second fuel. In certain embodiments, the first or the second fuel passes through the intake pipe 122 to the heater control valve 130.

Figure 8:
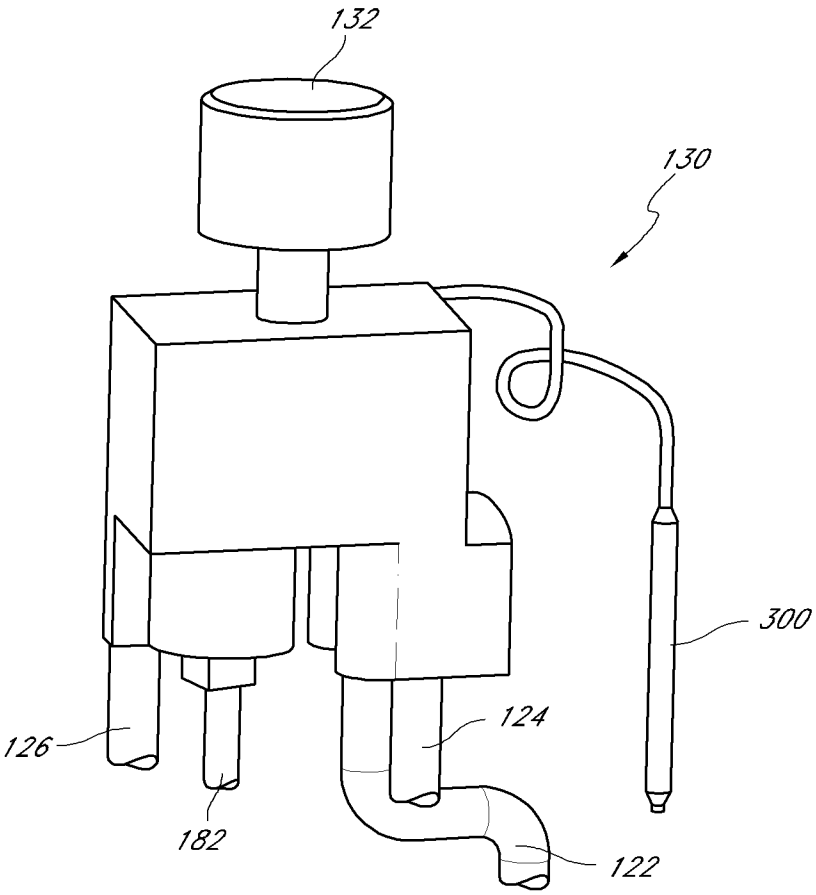
FIG. 8 is a perspective view of an embodiment of a heat control valve.

With reference to FIG. 8, in certain embodiments, the heater control valve 130 includes the knob 132. The heater control valve 130 can be coupled with the intake pipe 122, the fuel supply pipe 124 and the ODS pipe 126. In certain embodiments, the heater control valve 130 is coupled with the ODS thermocouple 182. In further embodiments, the heater control valve 130 comprises a temperature sensor 300.

In some embodiments, the heater control valve 130 allows a portion of the first or the second fuel to pass from the intake pipe 122 to the fuel supply pipe 124 and another portion to pass to the ODS pipe 126. In certain embodiments, the amount of fuel passing through the heater control valve 130 is influenced by the settings of the knob 132 and/or the functioning of the thermocouple 182. In some embodiments, the knob 132 is rotated by a user to select a desired temperature. Based on the temperature selected by the user and the temperature sensed by the temperature sensor 300, the heater control valve 130 can allow more or less fuel to pass to the fuel supply pipe 124.

Furthermore, as discussed below, when a pilot light of the ODS heats the thermocouple 182, a current is generated in the thermocouple 182. In certain embodiments, this current produces a magnetic field within the heater control valve 130 that maintains the valve 130 in an open position. If the pilot light goes out or is disturbed, and the current flow is reduced or terminated, the magnetic field weakens or is eliminated, and the valve 130 closes, thereby preventing passage therethrough of the first or the second fuel.

Figure 9:
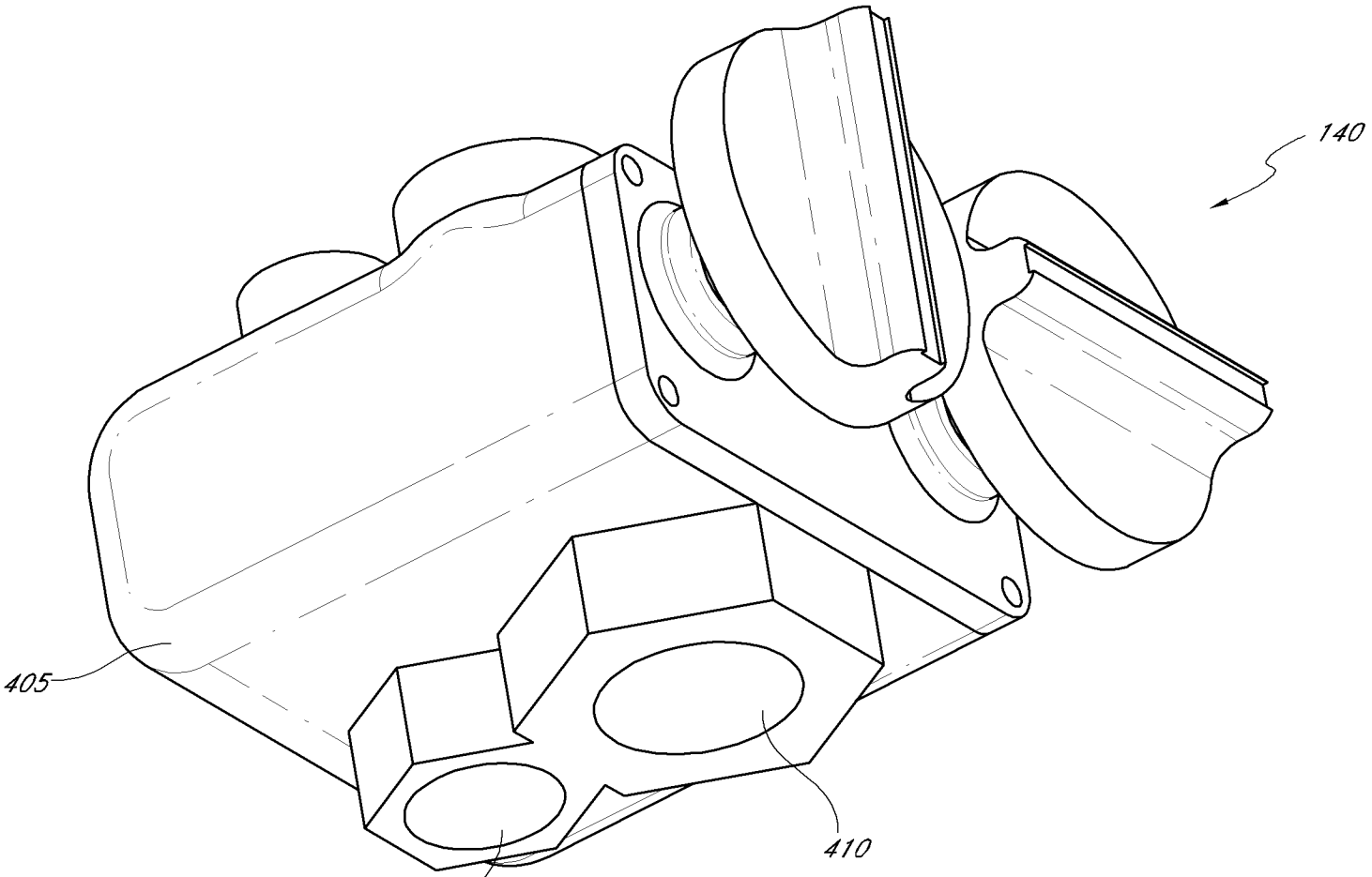
FIG. 9 is a perspective view of one embodiment of a fluid flow controller comprising two valves.

With reference to FIG. 9, in certain embodiments, the first or the second fuel allowed through the heater control valve 130 proceeds to the fluid flow controller 140. In certain embodiments, the controller 140 comprises a housing 405, a first inlet 410, and a second inlet 420. In some embodiments, the first inlet 410 is configured to couple with the fuel supply pipe 124 and the second inlet 420 is configured to couple with the ODS pipe 126.

Figure 10:
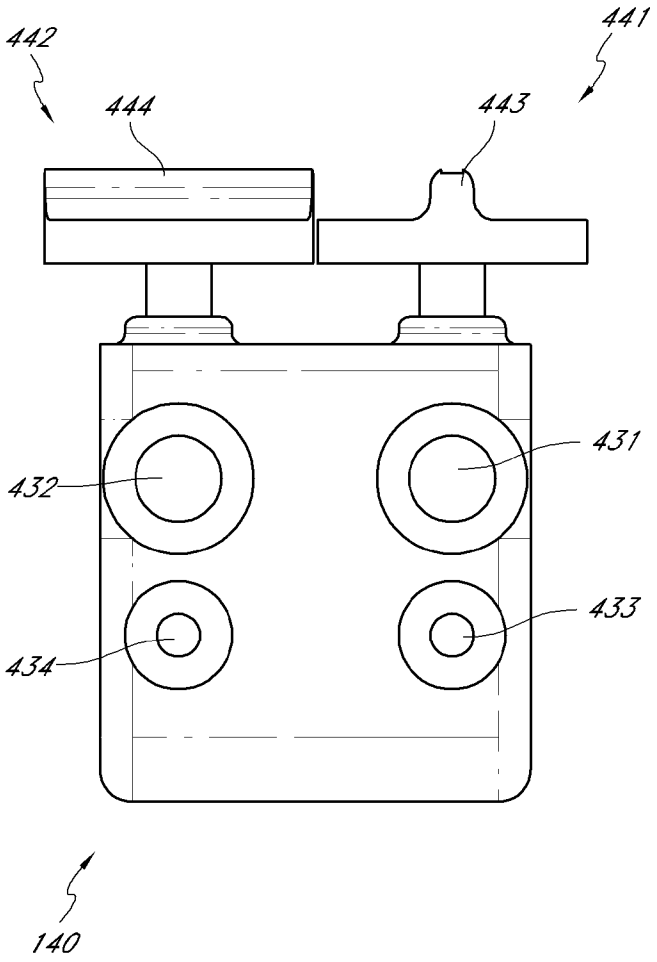
FIG. 10 is a bottom plan view of the fluid flow controller of FIG. 9.

With reference to FIG. 10, in certain embodiments, the fluid flow controller 140 comprises a first fuel supply outlet 431, and a second fuel supply outlet 432, a first ODS outlet 433, a second ODS outlet 434. In some embodiments, the fluid flow controller 140 further comprises a first selector valve 441 and a second selector valve 442. In some embodiments, a first selector control or knob 443 is coupled to the first selector valve 441 and a second selector knob 444 is coupled to the second selector valve 442.

Figure 11:
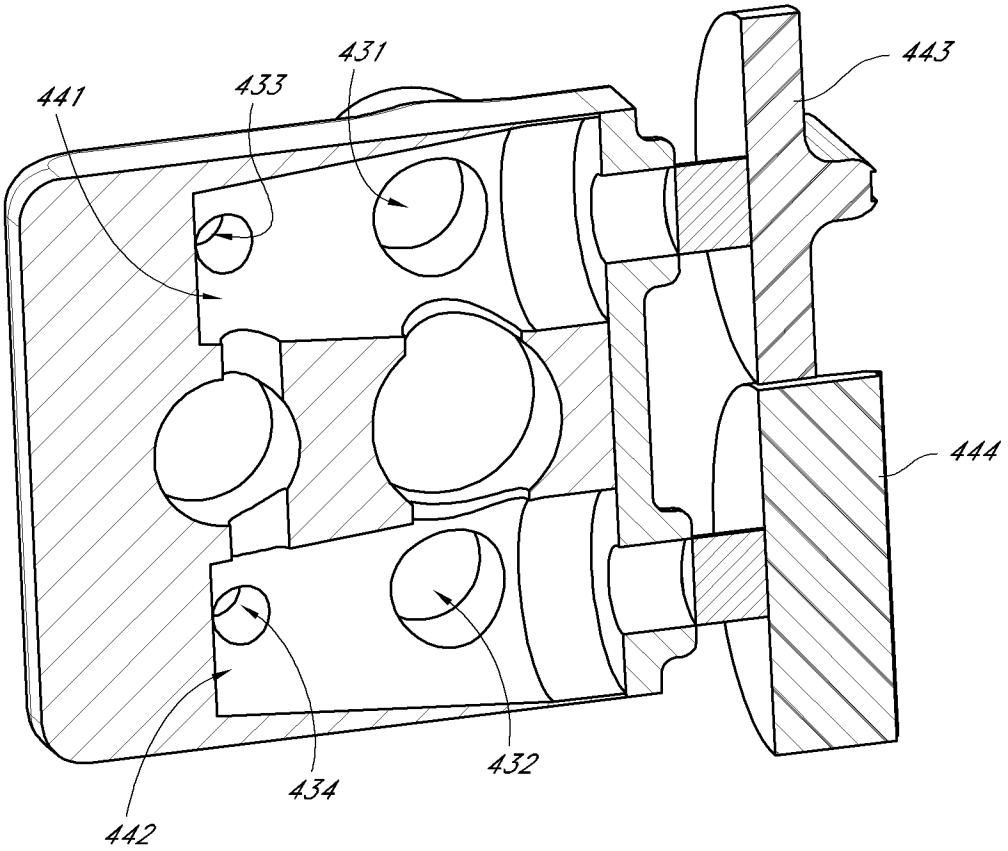
FIG. 11 is a cross-sectional view of the fluid flow controller of FIG. 9.

With reference to FIG. 11, in some embodiments, one of the first and second selector valves 441, 442 can be rotated within the housing via the first or second selector knob 443, 444, respectively. In some embodiments, the second selector valve 442 is closed and the first selector valve 441 is opened such that fluid flowing through the fuel supply pipe 124 proceeds to the first fuel supply outlet 431 and into the first nozzle line 141 and fluid flowing through the ODS pipe 126 proceeds to the first ODS outlet 433 and into the first ODS line 143. In other embodiments, the first selector valve 441 is closed and the second selector valve 442 is opened such that fluid flowing through the fuel supply pipe 124 proceeds to the second fuel supply outlet 432 and into the second nozzle line 142 and fluid flowing through the ODS pipe 126 proceeds to the second ODS outlet 434 and into the second ODS line 144. Accordingly, in certain embodiments, the fluid flow controller 140 can direct a first fluid to a first set of pipes 141, 143 leading to the nozzle 160 and the ODS 180, and can direct a second fluid to a second set of pipes 142, 144 leading to the nozzle 160 and the ODS 180.

Figure 12:
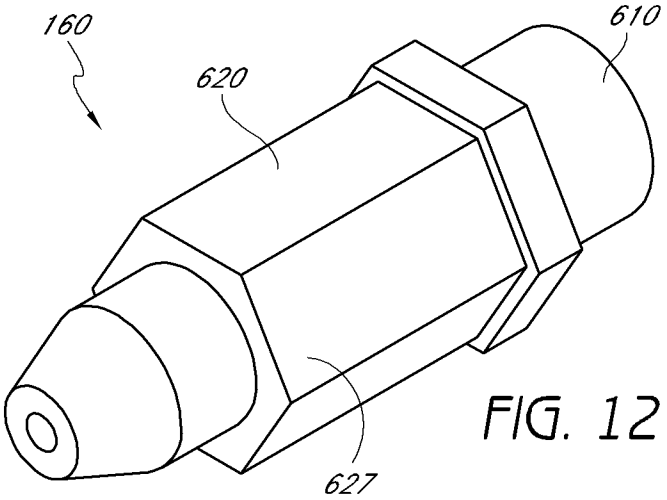
FIG. 12 is a perspective view of an embodiment of a nozzle comprising two inputs, two outputs, and two pressure chambers.

With reference to FIG. 12, in certain embodiments, the nozzle 160 comprises an inner tube 610 and an outer tube 620. The inner tube 610 and the outer tube 620 can cooperate to form a body of the nozzle 160. In some embodiments, the inner tube 610 and the outer tube 620 are separate pieces joined in substantially airtight engagement. For example, the inner tube 610 and the outer tube 620 can be welded, glued, secured in threaded engagement, or otherwise attached or secured to each other. In other embodiments, the inner tube 610 and the outer tube 620 are integrally formed of a unitary piece of material. In some embodiments, the inner tube 610 and/or the outer tube 620 comprises a metal.

Figure 13:
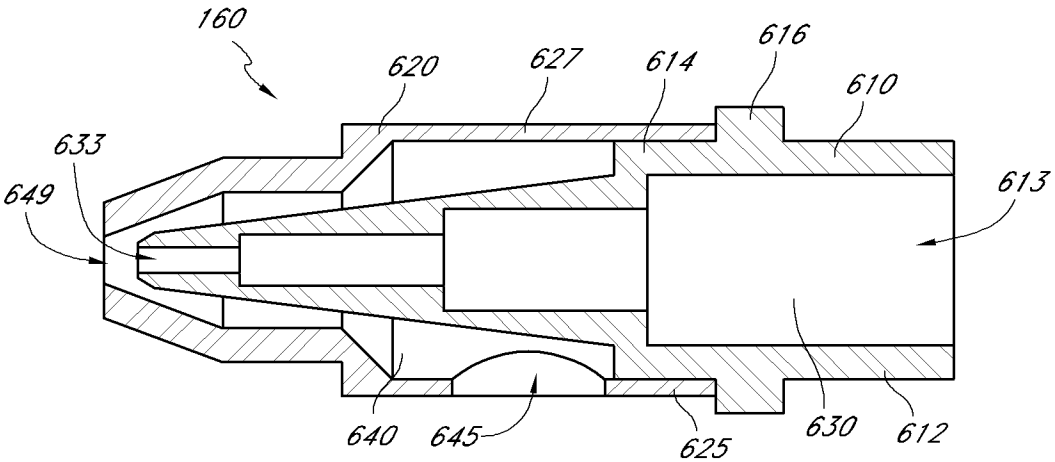
FIG. 13 is a cross-sectional view of the nozzle of FIG. 12 taken along the line 13-13 in FIG. 14.
Figure 14:
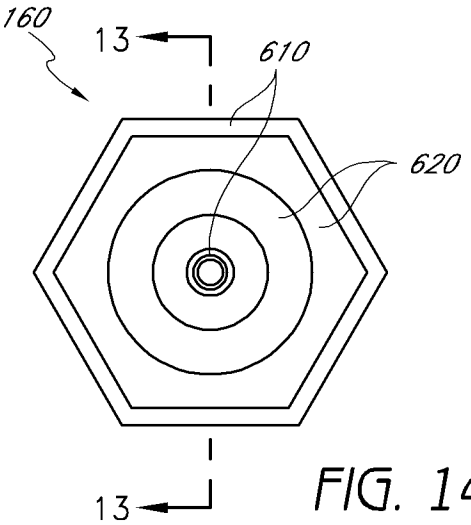
FIG. 14 is a top plan view of the nozzle of FIG. 12.

As illustrated in FIG. 13, in certain embodiments, the inner tube 610 and the outer tube 620 are elongated, substantially hollow structures. In some embodiments, a portion of the inner tube 610 extends inside the outer tube 620. As illustrated in FIGS. 13 and 14, in some embodiments, the inner tube 610 and the outer tube 620 can be substantially coaxial in some embodiments, and can be axially symmetric.

With continued reference to FIG. 13, in some embodiments, the inner tube 610 comprises a connector sheath 612. The connector sheath 612 can comprise an inlet 613 having an area through which a fluid can flow. In some embodiments, the connector sheath 612 is configured to couple with the second nozzle line 142, preferably in substantially airtight engagement. In some embodiments, an inner perimeter of the connector sheath 612 is slightly larger than an outer perimeter of the second nozzle line 142 such that the connector sheath 612 can seat snugly over the second nozzle line 142. In some embodiments, the connector sheath 612 is welded to the second nozzle line 142. In other embodiments, an interior surface of the connector sheath 612 is threaded for coupling with a threaded exterior surface of the second nozzle line 142. In still other embodiments, the second nozzle line 142 is configured to fit over the connector sheath 612.

In certain embodiments, the connector sheath 612 comprises a distal portion 614 that is configured to couple with the outer tube 620. In some preferred embodiments, each of the distal portion 614 of the inner tube 620 and a proximal portion 625 of the outer tube 620 comprises threads. Other attachment configurations are also possible.

In certain embodiments, the nozzle 160 comprises a flange 616 that extends from the connector sheath 612. In some embodiments, the flange 616 is configured to be engaged by a tightening device, such as a wrench, which can aid in securing the inner tube 610 to the outer tube 620 and/or in securing the nozzle 160 to the second nozzle line 142. In some embodiments, the flange 624 comprises two or more substantially flat surfaces, and in other embodiments, is substantially hexagonal (as shown in FIGS. 12 and 14).

In further embodiments, the outer tube 620 comprises a shaped portion 627 that is configured to be engaged by a tightening device, such as a wrench. In some embodiments, the shaped portion 627 is substantially hexagonal. In certain embodiments, the shaped portion 627 of the outer tube 620 and the flange 616 of the inner tube 610 can each be engaged by a tightening device such that the outer tube 620 and the inner tube 610 rotate in opposite directions about an axis of the nozzle 160.

In certain embodiments, the inner tube 610 defines a substantially hollow cavity or pressure chamber 630. The pressure chamber 630 can be in fluid communication with the inlet 613 and an outlet 633. In some embodiments, the outlet 633 defines an outlet area that is smaller than the area defined by the inlet 613. In preferred embodiments, the pressure chamber 630 decreases in cross-sectional area toward a distal end thereof. In some embodiments, the pressure chamber 630 comprises two or more substantially cylindrical surfaces having different radii. In some embodiments, a single straight line is collinear with or runs parallel to the axis of each of the two or more substantially cylindrical surfaces.

In some embodiments, the outer tube 620 substantially surrounds a portion of the inner tube 610. The outer tube 620 can define an outer boundary of a hollow cavity or pressure chamber 640. In some embodiments, an inner boundary of the pressure chamber 640 is defined by an outer surface of the inner tube 610. In some embodiments, an outer surface of the pressure chamber 640 comprises two or more substantially cylindrical surfaces joined by substantially sloped surfaces therebetween. In some embodiments, a single straight line is collinear with or runs parallel to the axis of each of the two or more substantially cylindrical surfaces.

In preferred embodiments, an inlet 645 and an outlet 649 are in fluid communication with the pressure chamber 640. In some embodiments, the inlet 645 extends through a sidewall of the outer tube 620. Accordingly, in some instances, the inlet 645 generally defines an area through which a fluid can flow. In some embodiments, the direction of flow of the fluid through the inlet 645 is nonparallel with the direction of flow of a fluid through the inlet 613 of the inner tube 610. In some embodiments, an axial line through the inlet 645 is at an angle with respect to an axial line through the inlet 613. The inlet 645 can be configured to be coupled with the first nozzle line 141, preferably in substantially airtight engagement. In some embodiments, an inner perimeter of the inlet 645 is slightly larger than an outer perimeter of the first nozzle line 141 such that the inlet 645 can seat snugly over the first nozzle line 141. In some embodiments, the outer tube 620 is welded to the first nozzle line 141.

In certain embodiments, the outlet 649 of the outer sheath 620 defines an area smaller than the area defined by the inlet 645. In some embodiments, the area defined by the outlet 649 is larger than the area defined by the outlet defined by the outlet 613 of the inner tube 610. In some embodiments, the outlet 613 of the inner tube 610 is within the outer tube 620. In other embodiments, the inner tube 610 extends through the outlet 649 such that the outlet 613 of the inner tube 610 is outside the outer tube 620.

In certain embodiments, a fluid exits the second nozzle line 142 and enters the pressure chamber 630 of the inner tube 610 through the inlet 613. The fluid proceeds through the outlet 633 to exit the pressure chamber 630. In some embodiments, the fluid further proceeds through a portion of the pressure chamber 640 of the outer tube 620 before exiting the nozzle 160 through the outlet 649.

In other embodiments, a fluid exits the first nozzle line 142 and enters the pressure chamber 640 of the outer tube 620 through the inlet 645. The fluid proceeds through the outlet 633 to exit the pressure chamber 640 and, in many embodiments, exit the nozzle 160. In certain embodiments, a fluid exiting the second nozzle line 142 and traveling through the pressure chamber 630 is at a higher pressure than a fluid exiting the first nozzle line 141 and traveling through the pressure chamber 640. In some embodiments, liquid propane travels through the pressure chamber 630, and in other embodiments, natural gas travels through the pressure chamber 640.

Figure 15:
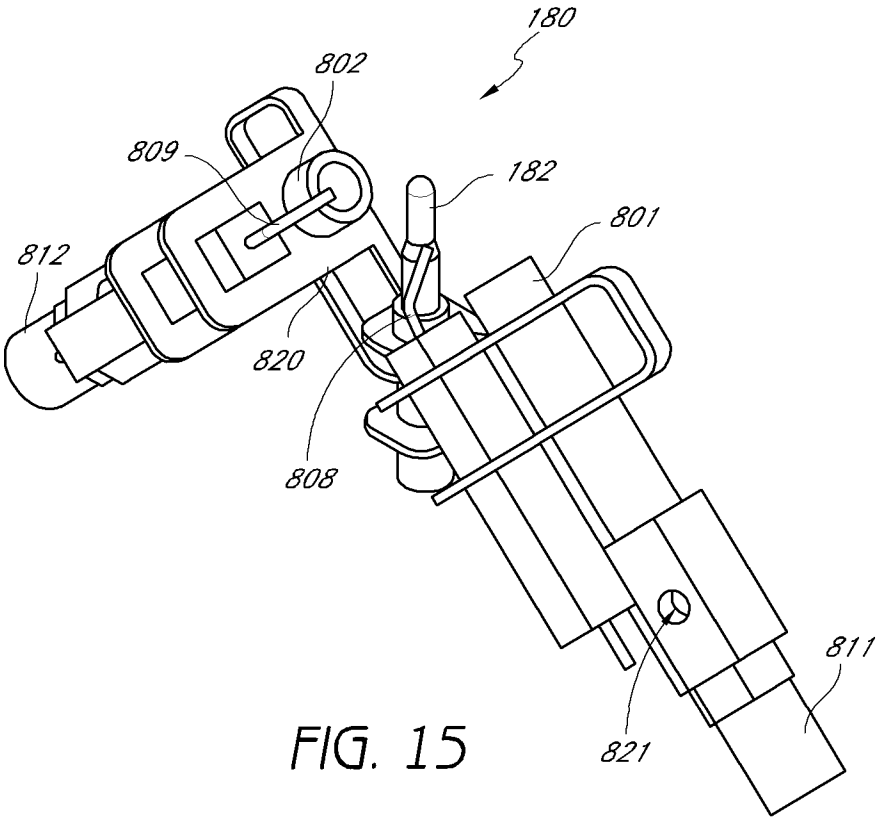
FIG. 15 is a perspective view of an embodiment of an oxygen depletion sensor (ODS) comprising two injectors and two nozzles.
Figure 16:
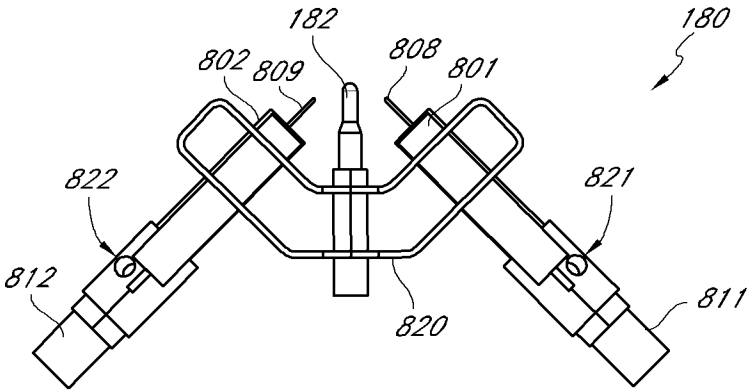
FIG. 16 is a front plan view of the ODS of FIG. 15.
Figure 17:
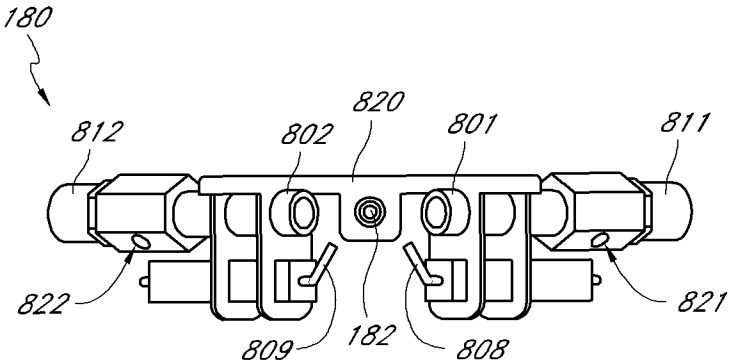
FIG. 17 is a top plan view of the ODS of FIG. 15.

With reference to FIG. 15-17, in certain embodiments, the ODS 180 comprises a thermocouple 182, a first nozzle 801, a second nozzle 802, a first electrode 808, and a second electrode 809. In further embodiments, the ODS 180 comprises a first injector 811 coupled with the first ODS line 143 (see FIGS. 1 and 2) and the first nozzle 801 and a second injector 812 coupled with the second ODS line 144 (see FIGS. 1 and 2) and the second nozzle 802. In many embodiments, the first and second injectors 811, 812 are standard injectors as are known in the art, such as injectors that can be utilized with liquid propane or natural gas. In some embodiments, the ODS 180 comprises a frame 820 for positioning the constituent parts of the ODS 180.

In some embodiments, the first nozzle 801 and the second nozzle 802 are directed toward the thermocouple such that a stable flame exiting either of the nozzles 801, 802 will heat the thermocouple 182. In certain embodiments, the first nozzle 801 and the second nozzle 802 are directed to different sides of the thermocouple 182. In some embodiments, the first nozzle 801 and the second nozzle 802 are directed to opposite sides of the thermocouple 182. In some embodiments, the first nozzle 801 is spaced at a greater distance from the thermocouple than is the second nozzle 802.

In some embodiments, the first nozzle 801 comprises a first air inlet 821 at a base thereof and the second nozzle 802 comprises a second air inlet 822 at a base thereof. In various embodiments, the first air inlet 821 is larger or smaller than the second air inlet 822. In many embodiments, the first and second injectors 811, 812 are also located at a base of the nozzles 801, 802. In certain embodiments, a gas or a liquid flows from the first ODS line 143 through the first injector 811, through the first nozzle 801, and toward the thermocouple 182. In other embodiments, a gas or a liquid flows from the second ODS line 144 through the second injector 812, through the second nozzle 802, and toward the thermocouple 182. In either case, the fluid flows near the first or second air inlets 821, 822, thus drawing in air for mixing with the fluid. In certain embodiments, the first injector 811 introduces a fluid into the first nozzle 801 at a first flow rate, and the second injector 812 introduces a fluid into the second nozzle 802 at a second flow rate. In various embodiments, the first flow rate is greater than or less than the second flow rate.

In some embodiments, the first electrode 808 is positioned at an approximately equal distance from an output end of the first nozzle 801 and an output end of the second nozzle 802. In some embodiments, a single electrode is used to ignite fuel exiting either the first nozzle 801 or the second nozzle 802. In other embodiments, a first electrode 808 is positioned closer to the first nozzle 801 than to the second nozzle 802 and the second electrode 809 is positioned nearer to the second nozzle 802 than to the first nozzle 801.

In some embodiments, a user can activate the electrode by depressing the igniter switch 186 (see FIG. 2). The electrode can comprise any suitable device for creating a spark to ignite a combustible fuel. In some embodiments, the electrode is a piezoelectric igniter.

In certain embodiments, igniting the fluid flowing through one of the first or second nozzles 801, 802 creates a pilot flame. In preferred embodiments, the first or the second nozzle 801, 802 directs the pilot flame toward the thermocouple such that the thermocouple is heated by the flame, which, as discussed above, permits fuel to flow through the heat control valve 130.

Figure 18:
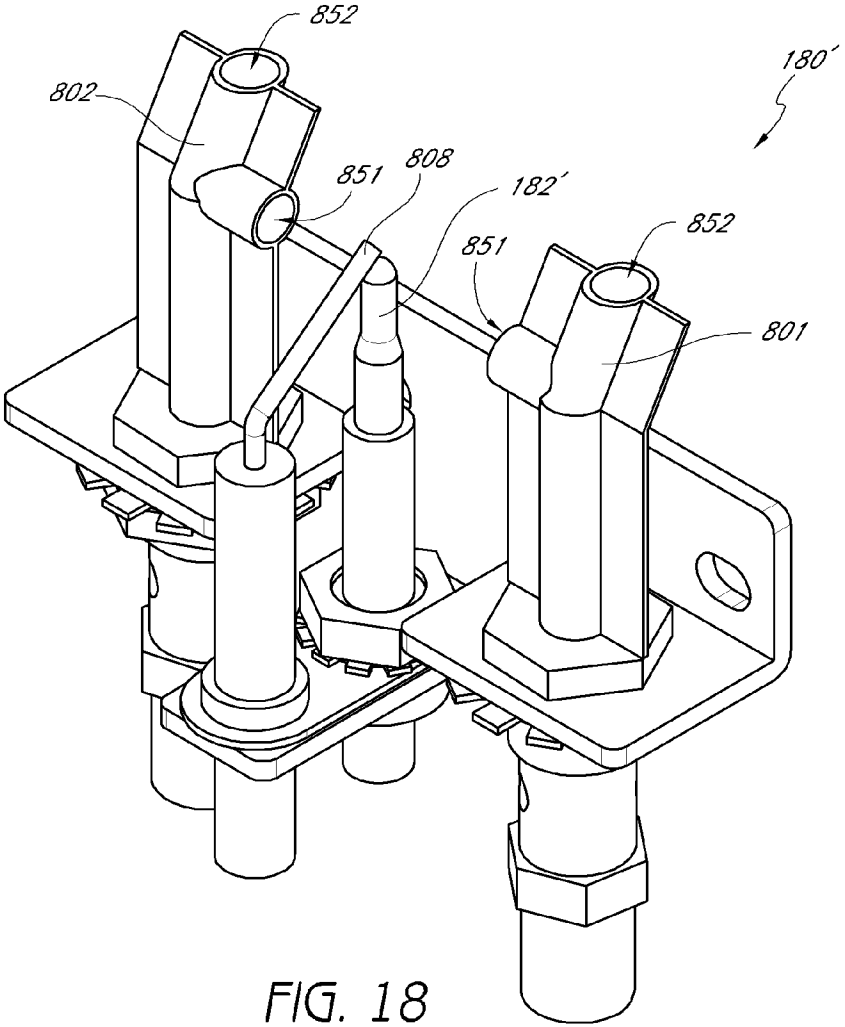
FIG. 18 is a perspective view of another embodiment of an ODS comprising two injectors and two nozzles.

FIG. 18 illustrates another embodiment of the ODS 180'. In the illustrated embodiment, the ODS 180' comprises a single electrode 808. In the illustrated embodiment, each nozzle 801, 802 comprises a first opening 851 and a second opening 852. In certain embodiments, the first opening 851 is directed toward a thermocouple 182', and the second opening 852 is directed substantially away from the thermocouple 182'.

In various embodiments, the ODS 180 provides a steady pilot flame that heats the thermocouple 182 unless the oxygen level in the ambient air drops below a threshold level. In certain embodiments, the threshold oxygen level is between about 18 percent and about 18.5 percent. In some embodiments, when the oxygen level drops below the threshold level, the pilot flame moves away from the thermocouple, the thermocouple cools, and the heat control valve 130 closes, thereby cutting off the fuel supply to the heater 10.

Figure 19:
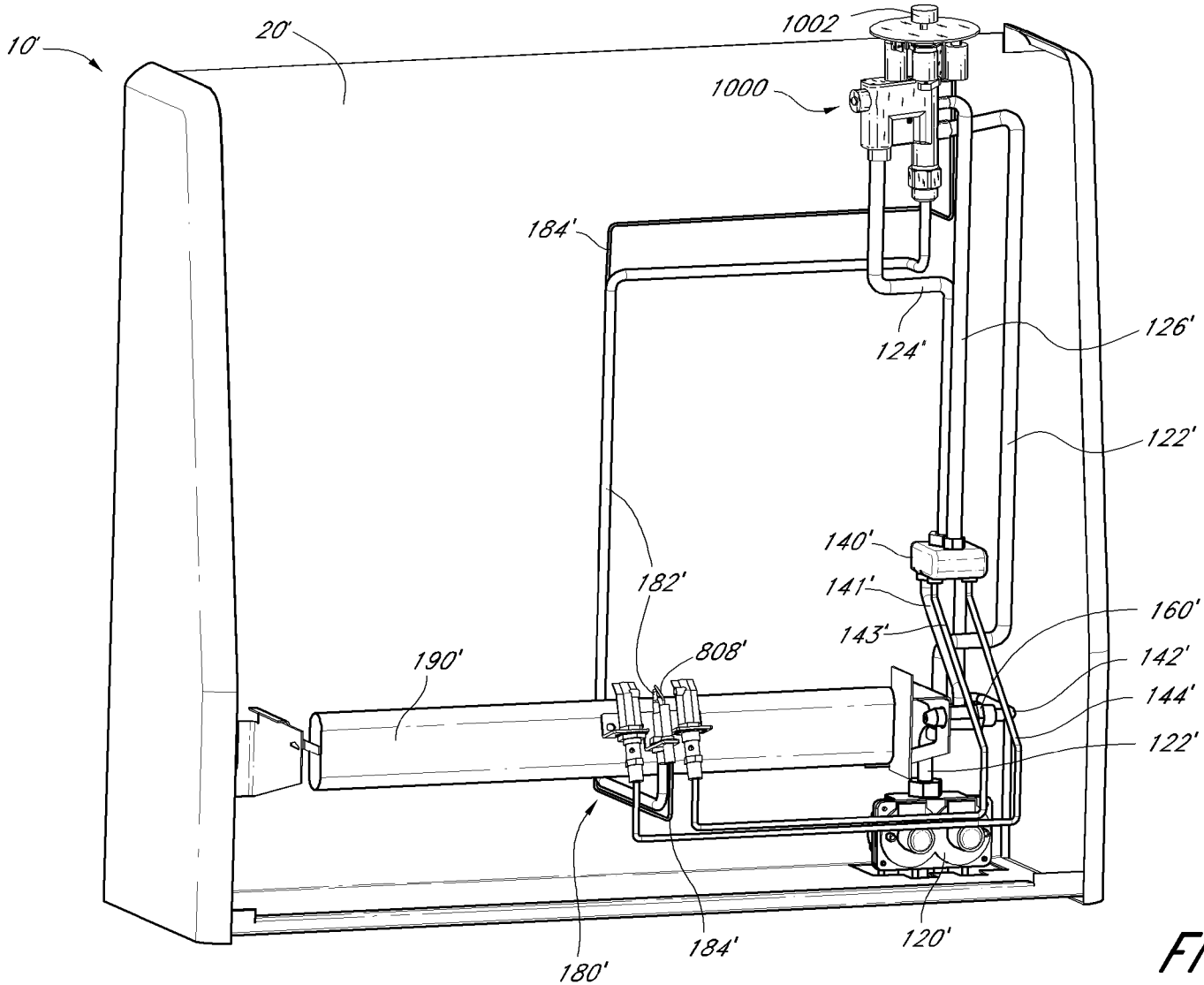
FIG. 19 is a perspective cutaway view of a portion of an embodiment of a heater comprising an embodiment of a control valve assembly.

FIG. 19 illustrates another embodiment of a heater 10'. In certain embodiments, the heater 10' and/or one or more components thereof is similar to the heater 10 and/or one or more components thereof, described above, thus similar features are identified with similar, primed reference numerals. Accordingly, as with the heater 10, in some embodiments, the heater 10' is a vent-free infrared heater, a vent-free blue flame heater, or some other variety of heater, such as a direct vent heater. In certain embodiments, the heater 10' comprises a stove, fireplace, gas log set, or gas log insert. Other configurations are also possible for the heater 10'. In many embodiments, the heater 10' is configured to be mounted to a wall or a floor or to otherwise rest in a substantially static position. In other embodiments, the heater 10' is configured to move within a limited range. In still other embodiments, the heater 10' is portable.

In certain embodiments, the heater 10' comprises a housing 20'. The housing 20' can enclose or partially enclose components of the heater 10' including, for example, a regulator 120'. The regulator 120' preferably is coupled with a primary fuel line 122'. The primary line 122', or any other fuel delivery line described herein, can comprise a conduit, pipe, channel, or any other suitable structure for directing fluid flow. The primary line 122' can be coupled with a heater control valve or control valve assembly 1000, which in some embodiments, includes a dial or knob 1002. In some embodiments, the knob 1002 is configured to be manually manipulated by a user.

In many embodiments, the control valve assembly 1000 is coupled to a fuel supply line 124' and an oxygen depletion sensor (ODS) line 126', each being capable of being coupled with a fluid flow controller 140'. In some embodiments, the fluid flow controller 140' is coupled with a first nozzle line 141', a second nozzle line 142', an ODS line 143', and a second ODS line 144'. In some embodiments, the first and second nozzle lines 141', 142' are coupled with a nozzle 160', and the first and the second ODS lines 143', 144' are coupled with an ODS 180'. In some embodiments, the ODS 180' comprises a thermocouple 182' and an igniter line 184' that can be coupled to the control valve assembly 1000. Furthermore, in some embodiments, the heater 10' comprises a combustion chamber or burner 190' that may be configured to receive fuel from the nozzle 160'. Thus the heater 10' can be generally similar to the heater 10 described above with differences related to the control valve assembly 1000.

Although the control valve assembly 1000 is described herein in the context of the heater 10', which can be configured to operate using fluid fuel received from either a first source or a second source, it is appreciated that certain embodiments of the valve assembly 1000 are compatible with a variety of heat producing devices, including those configured to operate on only a single type of fuel. Some embodiments of the valve assembly 1000 are of particular utility with a variety of gas heaters and a variety of gas fireplace devices, such as gas log sets and fireplace inserts, whether of a dual-fuel-source or a single-fuel source variety.

With continued reference to FIG. 19 in some embodiments, the ODS 180' can be positioned on or near the burner 190', and can produce a pilot flame in sufficiently close proximity to the burner 190' to ignite fuel delivered to the burner 190'. The ODS 180' can also comprise an electrode 808' such as the electrode 808 described above. In some embodiments, the electrode 808' is configured to ignite fuel delivered to the ODS 180' and thus start the pilot flame. In some embodiments, the electrode 808' is sufficiently close to the burner 190' that it can ignite fuel delivered to the burner 190'. In the illustrated embodiment, the ODS 180' is configured to provide a pilot light for combusting fuel delivered to the burner 190', and includes an electrode 808' coupled to the control valve assembly 1000 via the igniter line 184', as discussed below.

Figure 20:
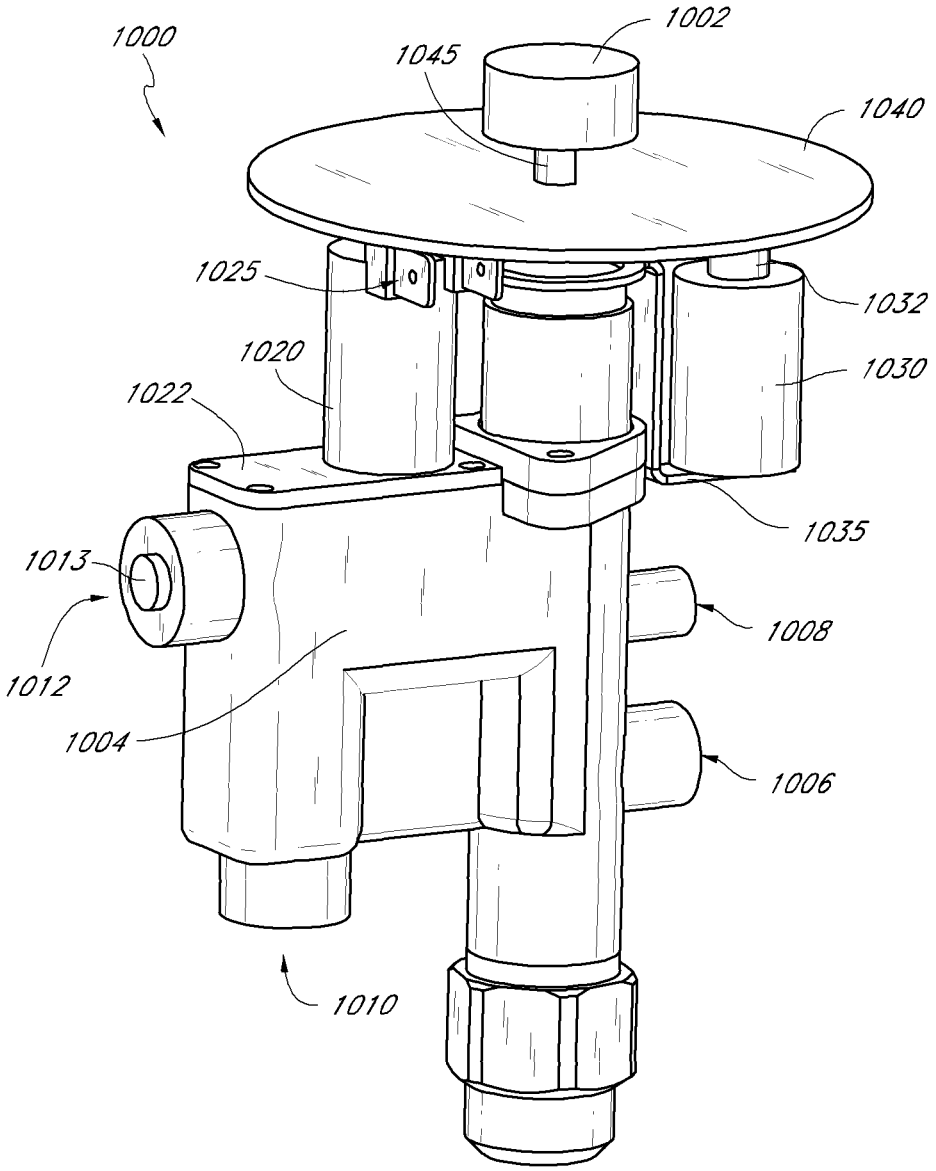
FIG. 20 is a perspective view of an embodiment of a control valve assembly compatible with the heater illustrated in FIG. 19.

With reference to FIG. 20, in certain embodiments, the control valve assembly 1000 includes a housing 1004, which can define a number of inlets and outlets. In some embodiments, the housing 1004 defines an inlet 1006 that is configured to receive fuel from the primary line 122'. The inlet 1006 can comprise any suitable interface for coupling with the primary line 122', and in some embodiments, defines a tube-like projection having internal or external threading. The housing 1004 can further define an ODS outlet 1008 configured to couple with and to deliver fuel to the ODS line 126'.

In certain embodiments, the housing 1004 defines a first burner outlet 1010 and a second burner outlet 1012. In some embodiments, the first burner outlet 1010 is coupled with the fuel supply line 124' and the second burner outlet 1012 is plugged or capped in any suitable manner. In other embodiments, the second burner outlet 1012 is coupled with the fuel supply line 124' and the first burner outlet 1012 is plugged or capped. Advantageously, such an arrangement of the housing 1004 can provide the control valve assembly 1000 with versatility such that the control valve assembly 1000 can be included in any of a variety of heaters having different piping configurations. Additionally, the outlets 1010 and 1012 can provide a variety of plumbing options to provide the shortest and/or most convenient plumbing path within a given heater 10'. The control valve assembly 1000 can thus reduce manufacturing costs and inventory demands. In other embodiments, the control valve assembly 1000 comprises either a first burner outlet 1010 or a second burner outlet 1012. The first and/or second burner outlets 1010, 1012 can be oriented in any suitable position for directing fuel from the control valve assembly 1000. In the illustrated embodiment, the first burner outlet 1010 is open and is configured to couple with the fuel supply line 124', and the second burner outlet 1012 is plugged with an insert 1013, which can comprise a bolt or other threaded piece, for example.

In certain embodiments, the assembly 1000 includes a temperature regulator 1020. The regulator 1020 can be coupled with the housing 1004 in any suitable manner, and in some embodiments, is mounted to a plate 1022 that is mounted to the housing 1004. As further described below, the regulator 1020 can include and/or be coupled with a thermostat for regulating the temperature of the environment surrounding the heater 10'. In some embodiments, the temperature regulator 1020 includes a power interface 1025 for coupling with any suitable power source. In other embodiments, the temperature regulator 1020 includes its own power source, such as, for example, a battery.

In some embodiments, the assembly 1000 includes an igniter 1030, which can include a sensor 1032. The igniter 1030 can comprise an intermittent igniter coupled with the electrode 808' via the igniter line 184'. The igniter 1030 is preferably capable of repeatedly firing the electrode 808' when the sensor 1032 is activated, as discussed further below. In certain embodiments, the sensor 1032 comprises a button that is relatively sensitive to pressure actuation (e.g., physical contact) such that even relatively slight contact with the sensor 1032 results in multiple firings of the electrode 808'. In other embodiments, the sensor 1032 comprises a magnetometer or some other suitable sensor that can detect movement of an object without physical contact with the object. The igniter 1030 can be coupled to the housing 1004 via a mounting bracket 1035, and in some embodiments, is substantially fixed relative to the housing 1004.

In certain embodiments, the assembly 1000 comprises an extension 1040. In some embodiments, the extension 1040 is substantially concealed by a portion of the housing 20' of the heater 10' such that the extension 1040 is not readily visible from outside of the assembled heater 10'. The extension 1040 can be integrally formed with or otherwise coupled with an actuator, pin, rod, or shaft 1045. In some embodiments, the extension 1040 extends radially from the shaft 1045. In some embodiments, the shaft 1045 is coupled with the selector knob 1002.

In certain embodiments, the extension 1040 is substantially disk-shaped, and can have a radius larger than the distance between an axial center of the shaft 1045 and the sensor 1032 of the igniter 1030. Accordingly, in some embodiments, the extension 1040 is configured to contact the sensor 1032 and activate the igniter 1030 when the knob 1002 is depressed, regardless of the rotational orientation of the knob 1002, as further described below.

Figure 21:
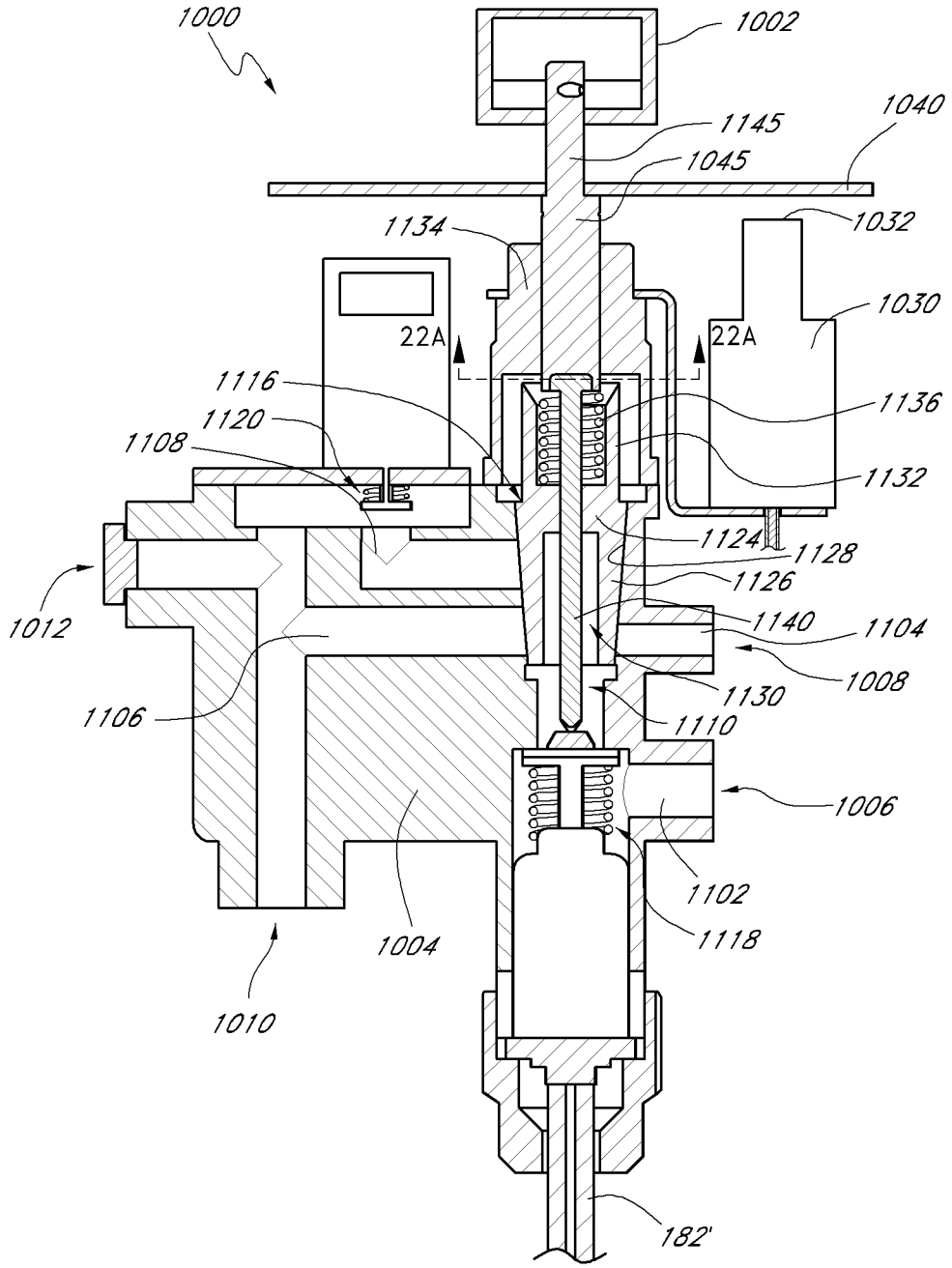
FIG. 21 is a cross-sectional view of the control valve assembly illustrated in FIG. 19 shown in an "off" configuration.

With reference to FIG. 21, the housing 1004 can define a plurality of fluid conduits, paths, pathways, or passageways. In various embodiments, the housing 1004 defines a primary passageway 1102 in fluid communication with the inlet 1006, an ODS passageway 1104 in fluid communication with the ODS outlet 1008, a first burner passageway 1106 in fluid communication with the first and/or second burner outlets 1010, 1012, and/or a second burner passageway 1108 in fluid communication with the first and/or second burner outlets 1010, 1012. The housing 1004 can also define a chamber 1110 from which one or more of the passageways 1102, 1104, 1106, 1108 extend.

In certain embodiments, the control valve assembly 1000 includes one or more valves configured to control fuel flow through one or more of the passageways 1102, 1104, 1106, 1108. As used herein, the term valve is a broad term used in its ordinary sense, and can include, without limitation, a device or structure configured to permit fluid flow in one or more directions and/or to substantially prevent fluid flow in one or more directions, and can further include structures capable of being positioned in two or more operational states such that, in a first state, fluid flow is permitted and/or substantially prevented in one or more different directions than is permitted and/or substantially prevented in a second state. The control valve assembly 1000 can include a primary valve 1118, which in some embodiments, is configured to control fuel flow into the control valve assembly 1000 in response to input from the thermocouple 182', as further discussed below. In some embodiments, the control valve assembly 1000 includes a regulator valve 1120 configured to control fuel flow through the second burner passageway 1108, as further discussed below. In some embodiments, one or more of the primary valve 1118 and the regulator valve 1120 functions as a shutoff valve, and can thus be configured to prevent fluid flow under certain circumstances.

In some embodiments, the control valve assembly 1000 includes a controller valve 1116 that preferably is configured to be movable to a variety of different orientations or operational states. In some embodiments, the controller valve 1116 comprises a valve body 1124 configured to be received in the chamber 1110 defined by the housing 1004. In some embodiments, the valve body 1124 comprises a substantially frusto-conical lower section 1126, and can be complementary to an inner wall 1128 of the housing 1004 that defines at least a portion of the chamber 1110. Accordingly, in some embodiments, the valve body 1124 forms a substantially fluid-tight seal with the inner wall 1128 of the housing 1004. Shapes and complementarities other than frustoconical are also possible for the valve body 1124 and the inner wall 1128. For example, in some embodiments, the valve body 1124 and the inner wall 1128 are each substantially cylindrical. In some embodiments, a lubricant is included between the valve body 1124 and the inner wall 1128 to permit the valve body 1124 to move relatively freely with respect to the housing 1004. The valve body 1124 can be configured to rotate relative to the housing 1004 so as to selectively permit fuel to flow from the inlet 1006 to one or more of the outlets 1008, 1010, and 1012.

In some embodiments, the valve body 1124 defines a hollow central portion 1130 and may further define a variety of ports (see FIGS. 23-25) that pass through the lower portion 1126 to control fuel flow through the control valve assembly 1000. The valve body 1124 also preferably comprises an upper portion 1132 that can be substantially interior to a cap 1134 attached to an upper end of the housing 1004 in an assembled control valve assembly 1000. Located within the upper portion 1132 of the valve body 1124 preferably is a biasing member 1136 that is configured to bias the shaft 1045 upwards relative to the cap 1134. The biasing member 1136 can comprise a spring or other resilient element. In some embodiments, a rod 1140 extends downward from a lower end of the shaft 1045. The rod 1140 can extend through the valve body 1124 and, in certain conditions, open the primary valve 1118 when the shaft 1045 is moved downward, as described below.

References to spatial relationships, such as upper, lower, downward, etc., are made herein merely for convenience in describing embodiments depicted in the figures, and should not be construed as limiting. For example, such references are not intended to denote a preferred gravitational orientation of the control valve assembly 1000.

In some embodiments, fuel flow from the inlet 1006 and through the passageway 1102 preferably is controlled by the primary valve 1118, which in some embodiments, comprises a solenoid coupled with the thermocouple 182'. The chamber 1110 of the housing 1004 can be in fluid communication with the hollow portion 1130 of the valve body 1124. Accordingly, in some embodiments, fuel can pass from the chamber 1110 through the lower portion 1126 of the valve body 1124 and may enter one or more of the ODS passageway 1104, the first burner passageway 1106, and the second burner passageway 1108, depending on the orientation of the valve body 1124.

The shaft 1045 can assume any of a variety of suitable shapes or configurations, and can comprise a column, rod, stem, stock. In certain embodiments, the shaft 1045 includes an upper portion 1145 that extends through the extension 1040 and is coupled with the knob 1002. In some embodiments, the shaft 1045 defines a protrusion (see FIG. 22) that extends from a lower end thereof and is configured to fit within a longitudinal slit (not shown) defined by the upper portion 1132 of the valve body. Accordingly, in some embodiments, the shaft 1045 is capable of axial movement relative to the valve body 1124 and can rotate the valve body 1124 at any point within the range of axial movement of the shaft 1045. In some embodiments, the shaft 1045 can move axially between a resting, natural, or first state and a displaced or second state. In certain embodiments, when the shaft 1045 is in the resting state, the biasing member 1136 is substantially relaxed or undisturbed, and when the shaft 1045 is in the displaced state, the biasing member is deformed or compressed, and is thus biased to return the shaft 1045 to the resting state.

Figure 22A:
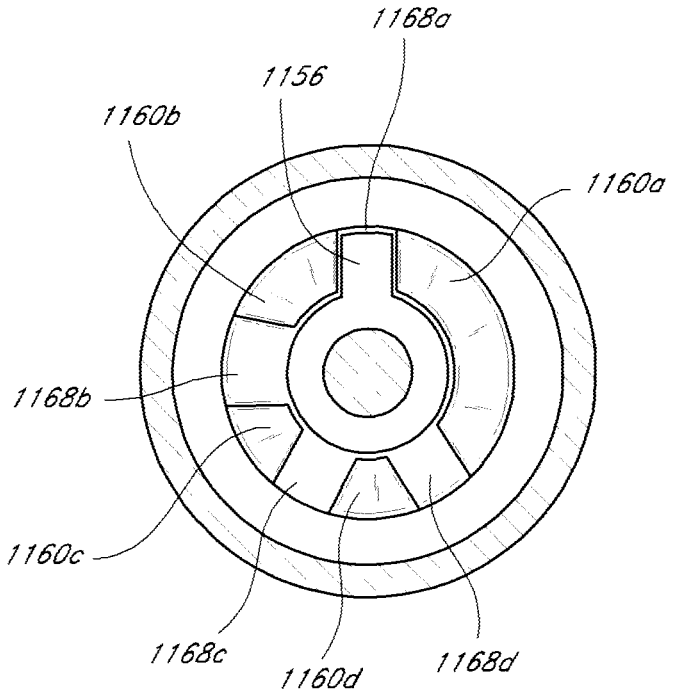
FIG. 22A is a partial cross-sectional view of the control valve assembly illustrated in FIG. 19 taken along the view line 22A-22A shown in FIG. 21.

With reference to FIG. 22A, in some embodiments, the shaft 1045 defines the protrusion 1156 and the cap 1134 defines a plurality of shelves or ridges 1160 and recesses, channels, or depressions 1168 configured to interact with the protrusion 1156. In the illustrated embodiment, the cap 1134 defines four ridges 1160*a-d* separated by four depressions 1168*a-d*. More or fewer ridges 1160 and depressions 1168 are possible. In certain embodiments, each depression 1168*a-d* corresponds with a different operational state of the valve assembly 1000, as described below. For example, in some embodiments, the depression 1168*a* corresponds with an "off" operational configuration, the depression 1168*b* corresponds with a "pilot" operational configuration, the depression 1168*c* corresponds with an "automatic" operational configuration, and the depression 1168*d* corresponds with a "manual" configuration, which are described below. In further embodiments, the ridge 1160*c* also corresponds with the "automatic" operational configuration and/or the ridge 1160*d* corresponds with the "manual" operational configuration. Other configurations of the cap 1134 and the shaft 1045 are also possible.

In some embodiments, each of the depressions 1168*a-d* is similarly sized and shaped, and can be configured to provide relatively little rotational freedom to the shaft 1045 when the protrusion 1156 is within the depressions 1168*a-d*. In certain embodiments, the shaft 1045 is in the displaced state when it is moved downward relative to the cap 1134 and out of one of the depressions 1168*a-d*. Accordingly, when the shaft 1045 is in the displaced state, the protrusion 1156 can pass under one or more of the ridges 1160*a-d*. The shaft 1045 can then be urged upward toward the resting state by the biasing member 1136 such that the protrusion 1156 is again located within one of the depressions 1168*a-d*. Accordingly, in some embodiments, the shaft 1045 is naturally in the resting state, due to the influence of the biasing member, with the protrusion 1156 located in one of the depressions 1168*a-d*, and the shaft 1045 is moved to a displaced state in order to rotate the shaft 1045 and the valve body 1124. As discussed below, in certain embodiments, the igniter 1030 is activated when the shaft 1045 is moved to the displaced state and is deactivated when the controller valve 1116 is moved to the resting state.

Figure 22B:
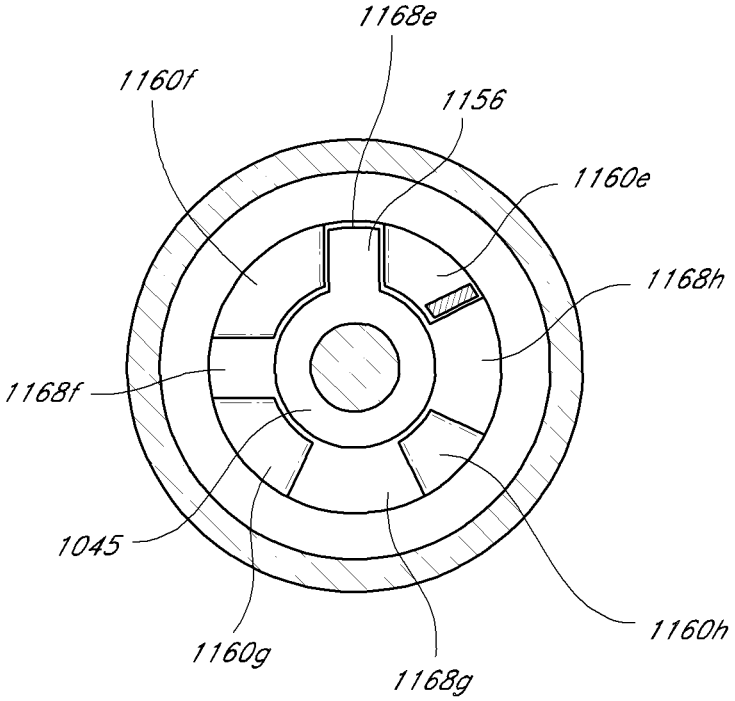
FIG. 22B is a partial cross-sectional view such as that shown in FIG. 22A depicting another embodiment of a control valve assembly.

As illustrated in FIG. 22B, in an alternative embodiment, the cap 1134 defines four ridges 1160*e-h* separated by four depressions 1168*e-h*. In some embodiments, the depression 1168*e* corresponds with the "off" operational configuration, the depression 1168*f* corresponds with the "pilot" operational configuration, the depression 1168*g* corresponds with the "automatic" operational configuration, and the depression 1168*g* corresponds with the "manual" configuration.

In some embodiments, the depressions 1168*e* and 1168*f* are similarly sized and shaped, and can be narrower than the depressions 1168*g* and 1168*h*. The depressions 1168*e* and 1168*f* can be sized and shaped so as to provide relatively little rotational freedom to the shaft 1045 when the protrusion 1156 is within the depressions 1168*e, f*. In contrast, the depressions 1168*g* and 1168*h* can be sized so as to provide the shaft 1045 with a relatively larger amount of rotational freedom when the protrusion 1156 is within the depressions 1168*g, h*.

In some embodiments, a center of each depression 1168*e-h* is offset from the center of each neighboring depression 1168*e-h* by approximately 90 degrees. In other embodiments, the depressions 1168*e-h* are spaced from each other by one or more other angular amounts. In certain embodiments, the cap 1134 defines a stop 1169 which can extend downward from the ridge 1160*e* and prevent movement of the protrusion 1156 greater than about 360 degrees.

With reference again to FIG. 21, the illustrated control valve assembly 1000 is shown in a first operational orientation or configuration, referred to herein for convenience, and not by limitation, as the "off" operational configuration. In the illustrated embodiment, the valve body 1124 is positioned such that none of the ports through the lower portion 1126 are aligned with the passageways 1104, 1106, and 1108, thus substantially preventing fluid communication between the chamber 1110 and the passageways 1104, 1106, and 1108. In many embodiments, the primary valve 1118 forms a substantially fluid-tight seal with a ledge defined by the housing 1004, thus preventing fluid communication between the passageway 1102 and chamber 1110. In the illustrated embodiment, the controller valve 1116 is in the resting state with the shaft 1045 biased upward by the biasing member 1136 such that the protrusion 1156 is located in the depression 1168*a* in the embodiment shown in FIG. 22A or 1168*e* in the embodiment shown in FIG. 22B, and the extension 1040 is spaced from the sensor 1032 of the igniter 1030. Accordingly, in certain embodiments, fuel is substantially prevented from entering the valve assembly 1000 and the igniter 1030 is in an inactivated state when the valve assembly 1000 is in the "off" configuration.

Figure 23:
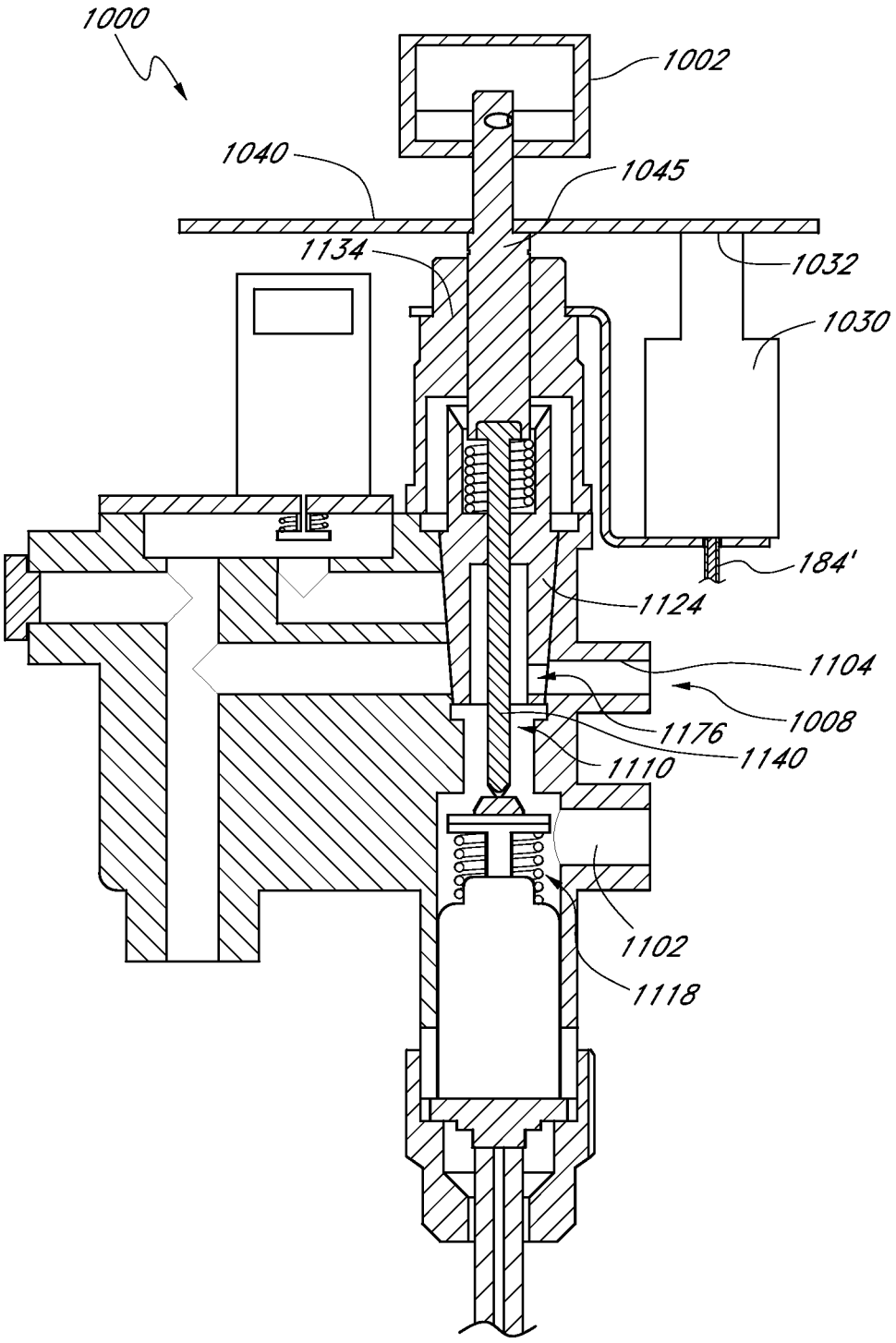
FIG. 23 is a cross-sectional view of the control valve assembly illustrated in FIG. 19 shown in a "pilot" configuration.

FIG. 23 illustrates an embodiment of the control valve assembly 1000 in another configuration, referred to herein for convenience, and not by limitation, as the "pilot" configuration. In certain embodiments, the ODS 180' can be ignited when the valve assembly 1000 is in the "pilot" configuration. As mentioned above in the particular illustrated embodiment the ODS 180' also serves as the pilot light. In other embodiments the pilot light and the ODS may comprise separate assemblies.

In certain embodiments, the shaft 1045 is moved downward relative to the cap 1134 to the displaced state in order to rotate the shaft 1045 from the "off" orientation. In some embodiments, as the shaft 1045 is rotated relative to the cap 1134, the extension 1040 continuously contacts the sensor 1032 and thus continuously activates the igniter 1030. In some embodiments, the igniter 1030 intermittently activates the electrode 808' via the igniter line 184'. The electrode 808' thus combusts any fuel delivered to the ODS 180'. When the shaft 1045 is in the displaced state, the rod 1140 preferably opens the primary valve 1118 such that the primary passageway 1102 is placed in fluid communication with the chamber 1110.

In some embodiments, by rotating the shaft 1045 to the "pilot" configuration, an ODS hole, opening, aperture, or port 1176 defined by the valve body 1124 is aligned with the ODS passageway 1104. Accordingly, in this configuration, fuel can flow into the inlet 1006, through the chamber 1110, through the ODS port 1176, through the ODS passageway 1104, and through the ODS outlet 1008 to the ODS 180'. In some embodiments, the ODS port 1176 extends through a substantial portion of the perimeter of the valve body 1124 such that the port 1176 maintains communication between the chamber 1110 and passageway 1104 as the valve body 1124 is rotated among a number of different orientations, such as, for example, among the "pilot" orientation, the "manual" orientation, and/or the "automatic" orientation. In some embodiments, the port 1176 is substantially ovoid. Accordingly, the valve body 1124 can advantageously permit fluid to flow to the ODS 180' as a user selects among a variety of operational states of the control valve assembly 1000, thereby maintaining a pilot flame.

In some embodiments, to ignite a pilot flame, the knob 1002 is depressed, which displaces the extension 1040 downward. The extension 1040 can in turn activate the igniter 1030, and thus activate the electrode 808'. Furthermore, in some embodiments, as the knob 1002 is depressed, the primary valve 1118 is manually held open by the rod 1140 until the thermocouple 182' generates sufficient current to maintain the primary valve 1118 in an open configuration. While the knob 1002 is depressed in order to place the controller valve 1116 in the "pilot" position, fuel flowing to the ODS 180' is ignited via the intermittent ignition provided by the igniter 1030. Certain embodiments are thus particularly advantageous in that a user activates the igniter 1030 in order to rotate the valve body 1124 and allow fuel to pass through the control valve assembly 1000, which can thus prevent un-ignited fuel from undesirably entering the environment. In some embodiments, if the knob 1002 is released before the thermocouple 182' has been heated by a sufficient amount to keep the primary valve 1118 open, the primary valve 1118 closes, thus cutting off the delivery of fuel to the ODS 180'.

In certain embodiments, as fuel is delivered to the ODS 180', the thermocouple 182' is heated and generates an electrical current that is delivered to the primary valve 1118, which maintains the valve 1118 in an open configuration. In other embodiments, the primary valve 1118 responds to some other electrical quantity communicated from the ODS 180', such as, for example, a voltage.

Figure 24:
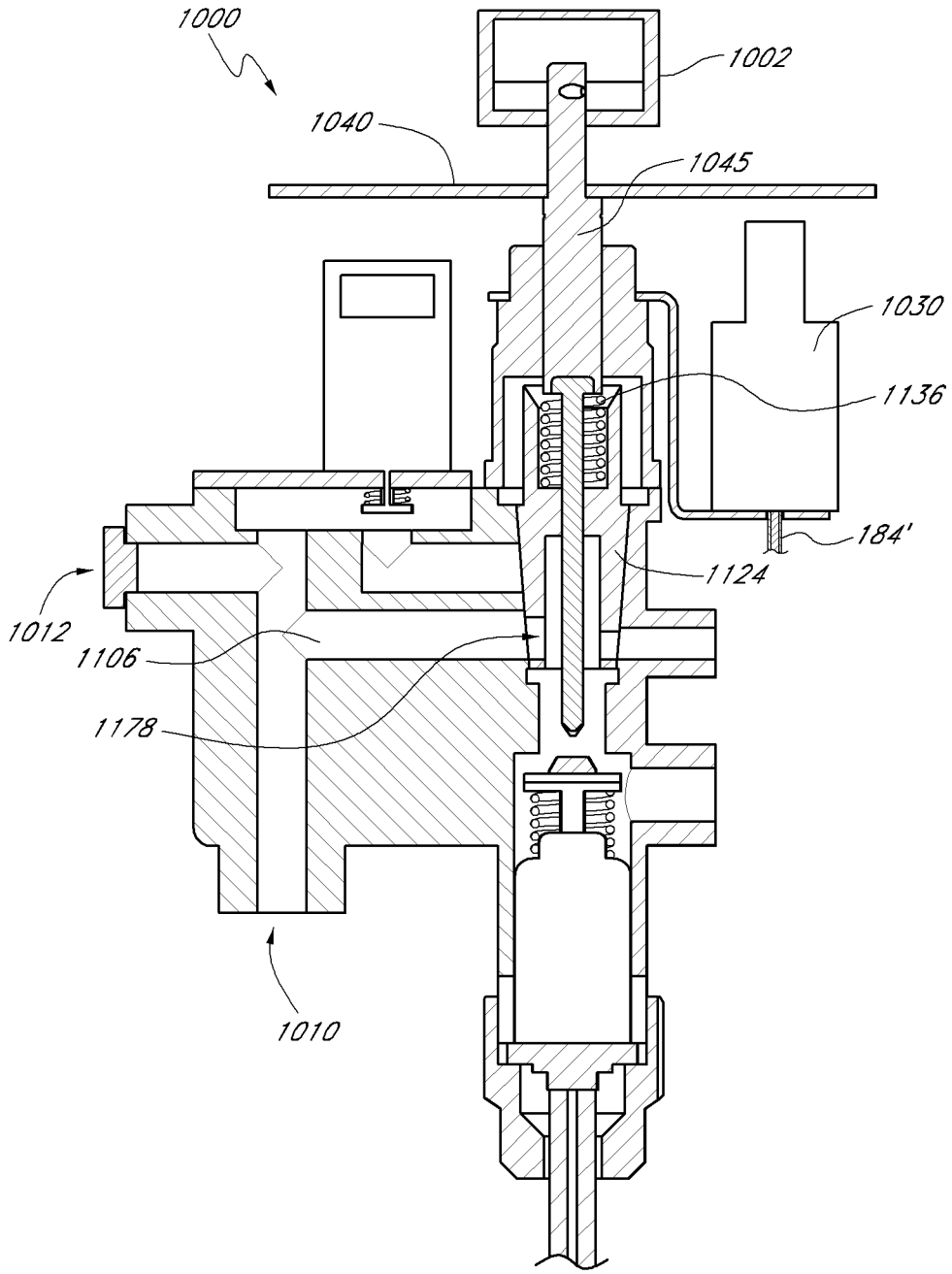
FIG. 24 is a cross-sectional view of the control valve assembly illustrated in FIG. 19 shown in a "manual" configuration.

FIG. 24 illustrates an embodiment of the control valve assembly 1000 in another configuration, referred to herein for convenience, and not by limitation, as a "manual" configuration. In some embodiments, the knob 1002 is depressed and then rotated to place the control valve assembly 1000 in the "manual" configuration. As described above, when the knob 1002 is depressed the extension 1040 preferably activates the igniter 1030, which in turn intermittently ignites the electrode 808'. In some embodiments, the valve body 1124 is rotated such that a burner port 1178 aligns with the first burner passageway 1106 and thus allows fuel to pass from the chamber 1110, through the passageway 1106, and through the first burner outlet 1010.

As previously discussed, the ODS port 1176 preferably is configured such that the port 1176 maintains communication between the chamber 1110 and the passageway 1104 as the valve body 1124 transitions between the "pilot" configuration and the "manual" configuration. Although in the illustrated embodiment the port 1176 maintains communication between the chamber 1110 and the passageway 1104 as the valve assembly 1000 transitions among various operational states, other suitable configurations are also possible.

The burner port 1178 preferably is configured to permit a range of fluid flow through the passageway 1106. As the valve body 1124 is rotated, the degree of alignment of the burner port 1178, which is substantially circular in some embodiments, with the passageway 1106 can change such that relatively more or less fuel is permitted into the passageway 1106. For example, in the embodiment shown in FIG. 22A, a portion of the burner port 1178 can be aligned with an opening into the passageway 1106 as the protrusion 1156 rests on the ridge 1160*d*. The portion of the burner port 1178 that is aligned with the passageway 1106 can increase as the protrusion is rotated toward the depression 1168*d*. In some embodiments, the burner port 1178 and the passageway are maximally aligned when the protrusion 1156 rests within the depression 1168*d*.

Alternatively, in the embodiment shown in FIG. 22B, the degree of alignment of the burner port 1178 and the passageway 1106 can be adjusted as the protrusion 1156 retained in the relatively depression 1168*h*. In some embodiments, the degree of alignment is relatively small (e.g., minimal) at one end of the depression 1168*h*, and is relatively large (e.g., maximal) at another end of the depression 1168*h*. In certain advantageous embodiments, altering the amount of fuel flow through the passageway can adjust the height of a flame produced at the burner 190'.

As described above with respect to the "pilot" configuration, in some advantageous embodiments, the igniter 1030 is activated as the valve assembly 1000 is placed in the "manual" configuration. Such an arrangement can have significant advantages over other arrangements in which activating an igniter and selecting an operational mode of a valve assembly can be performed separately. For example, in some valve assemblies, a user can depress a knob to open a cutoff valve that is operatively coupled with an ODS. Ordinarily the user depresses the knob with one hand to open fuel flow to a burner, and activates an igniter with another hand to combust the fuel delivered to the burner. Valve assemblies that permit a user to allow any amount of fuel to flow to the burner before igniting the fuel can allow undesirable amounts of un-ignited fuel into the environment. Furthermore, a two-step assembly of this sort can be inconvenient for users who wish to operate the system into which the valve assembly is integrated, but who may have only one hand free.

Furthermore, such systems can permit un-ignited fuel to pass through a valve assembly in a manner that is less apparent to many users. In some systems, a user normally depresses the knob of a control valve to permit fuel flow therethrough, separately ignites fuel permitted through the valve, and waits until a cut-off valve coupled with a thermocouple is heated sufficiently before releasing the knob. When the thermocouple is sufficiently hot, the cut-off valve permits continuous fuel flow to the burner, and when the thermocouple is relatively cooler, the cut-off valve prevents fuel flow to the burner.

However, in some embodiments, after the thermocouple has been heated for a period and the fuel flow to the burner is manually turned off by a user, the cut-off valve remains open until the thermocouple has cooled down. In some instances, the cooling period between manual fuel cut-off and the shutting of the cut-off valve is about 40 to 45 seconds. Accordingly, if a user were to manually open the control valve during this cooling period and release the knob, un-ignited fuel could escape into the environment until the thermocouple cooled sufficiently to shut the cut-off valve. Such a result could be contrary to a user's understanding of the usual operation of the valve assembly, and could disadvantageously cause confusion for the user and/or present possible hazards. As previously discussed, certain advantageous embodiments of the control valve assembly 1000 can substantially eliminate the foregoing drawbacks.

Figure 25:
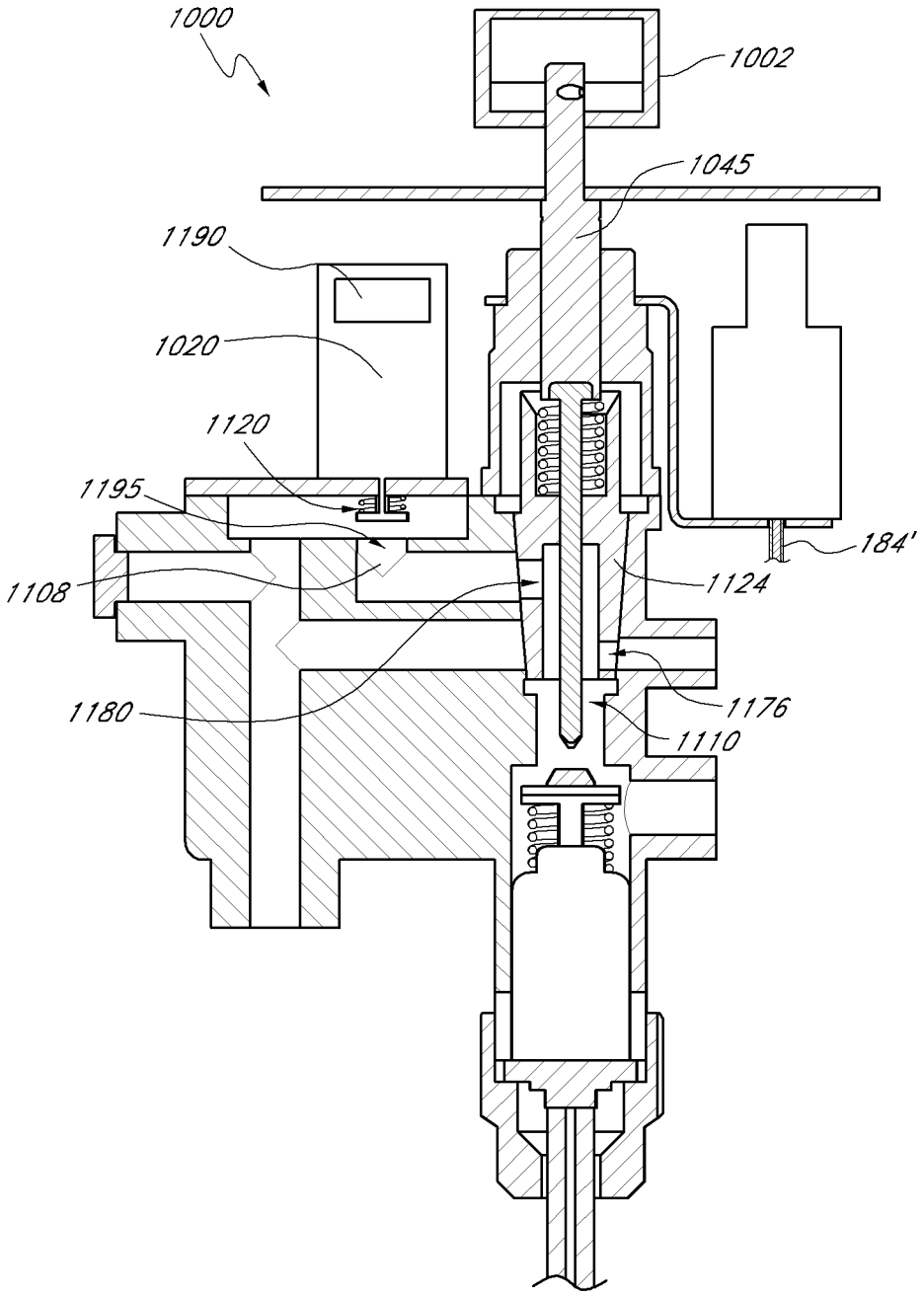
FIG. 25 is a cross-sectional view of the control valve assembly illustrated in FIG. 19 shown in an "automatic" configuration.

FIG. 25 illustrates the control valve assembly 1000 in another operational configuration, referred to herein for convenience, and not by limitation, as the "automatic" configuration. As with the "pilot" and "manual" configurations described above, in some embodiments, the knob 1002 is depressed and rotated to the "automatic" orientation. Rotating the knob 1002 and, in some embodiments, the shaft 1045 preferably rotates the valve body 1124 so as to align a port 1180 with the passageway 1108 and align the ODS port 1176 with the ODS passageway 1104. In some embodiments, the port 1180 resembles the port 1178, and can be substantially circular. Other configurations are also possible. The port 1180 can provide fluid communication between the chamber 1110 and the passageway 1108, and can permit fuel to flow through the passageway 1108 and the first burner outlet 1010. Additionally, in some embodiments, the port 1178 (see FIG. 24) is substantially closed when the valve assembly 1000 is in the "automatic" configuration such that fuel is directed out of the valve body 1124 only through the ports 1176 and 1180.

In some embodiments, the temperature regulator 1020 is configured to selectively seal the passageway 1108, and substantially prevent fuel flow therethrough, via the regulator valve 1120. For example, in some embodiments, the regulator valve 1120 is configured to seal a corridor 1195 of the passageway 1108. In some embodiments, the temperature regulator 1020 comprises a thermostat 1190 (shown schematically), which can be electrically coupled with a solenoid. The thermostat 1190 can comprise any suitable thermostat known in the art or yet to be devised. In some embodiments, the thermostat 1190 is configured to be adjusted via a remote-controller. The thermostat 1190 can be powered via any suitable power source, such as an electrical outlet or a battery, for example.

In some embodiments, the regulator valve 1120 is triggered when the thermostat 1190 detects a given environmental temperature and sends a signal to the regulator valve 1120. In some embodiments, the regulator valve 1120 seals the corridor 1195 when the thermostat 1190 detects a first temperature. In further embodiments, the regulator valve 1120 opens the corridor 1195 when the thermostat detects a second temperature that is lower than the first temperature. In some embodiments, the regulator valve 1120 repeatedly opens and closes the corridor 1195 as the first and second temperatures are detected.

As noted above, in some embodiments, the port 1176 is open when the control valve assembly 1000 is in the "automatic" configuration such that a pilot flame at the ODS is sustained when the regulator valve 1120 closes. Accordingly, when the regulator valve 1120 opens again and permits fuel to flow to the burner 190', the fuel is ignited by the pilot flame.

As with the "manual" configuration, in some embodiments, the valve body 1124 can be rotated when in the "automatic" configuration to adjust the degree of alignment of the port 1180 with the passageway 1108. For example, in some embodiments, the port 1180 and the passageway 1108 are slightly aligned as the protrusion 1156 of the shaft 1045 contacts the ridge 1160*c*, and are substantially completely aligned as the protrusion 1156 is retained in the depression 1168*c* (see FIG. 22A). In other embodiments, the protrusion 1156 of the shaft 1045 is retained in the relatively wide depression 1168*g* (see FIG. 22B), which can permit rotation of the shaft 1045 and valve body 1124. Accordingly, the valve body 1124 can permit varying amounts of fuel to flow to the burner 190' and can thus alter the size of a flame produced at the burner 190'. In certain advantageous embodiments, a user can select a desired environmental temperature via the temperature regulator 1020, and can also adjust the flame size at the burner 190'. As a result, when the assembly 1000 is in the "automatic" configuration, the user can independently select a flame size and environmental temperature to create a desired ambiance, in some embodiments.

Figure 26:
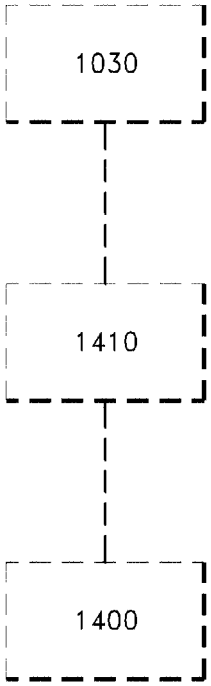
FIG. 26 is a schematic illustration of an embodiment of an igniter coupled with a thermocouple solenoid assembly.

FIG. 26 schematically illustrates an embodiment of a thermocouple solenoid assembly 1400. The thermocouple solenoid assembly 1400 can include a sensor 1410 which detects the presence of a flame at the ODS 180'. The sensor 1410 can deactivate the igniter 1030 when a flame is detected.

Figure 27:
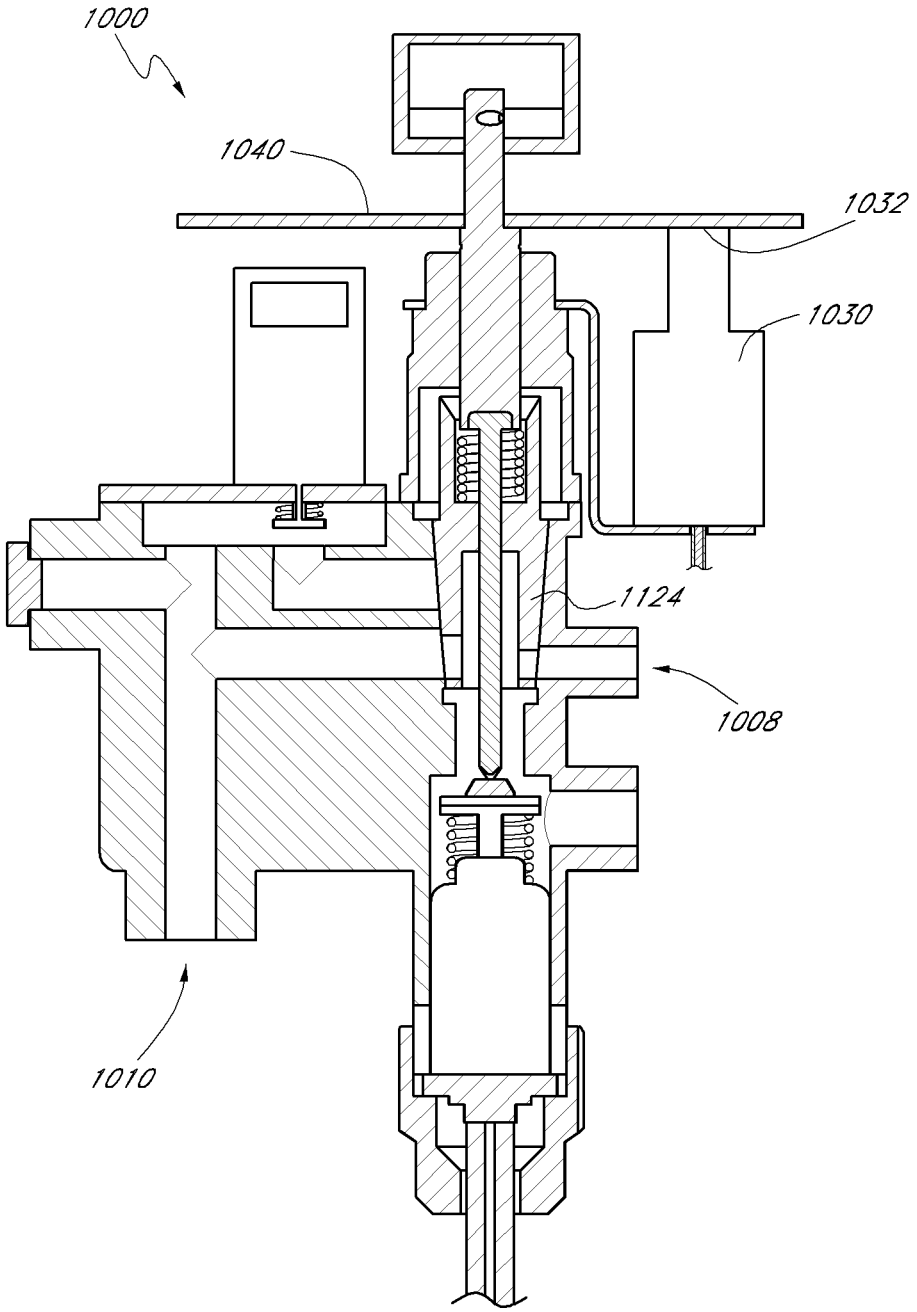
FIG. 27 is a cross-sectional view of an embodiment of the control valve assembly shown in a "manual" configuration.

FIG. 27 illustrates an embodiment of the control valve assembly 1000 in which the thermocouple solenoid assembly 1400 of FIG. 26 may be used. In some embodiments, the extension 1040 maintains contact with the sensor 1032 of the igniter 1030 whenever the control valve assembly 1000 is transitioned from the "off" configuration. In the illustrated embodiment, the control valve assembly 1000 is in the "manual" configuration.

As one having skill in the art will appreciate from at least the foregoing disclosure, in the illustrated embodiment, the extension 1040 continuously contacts the sensor 1032 when the control valve is moved to and remains in the "manual" configuration. Accordingly, when there is no flame at the ODS 180', the igniter 1030 repeatedly activates the electrode 808', which combusts any fuel delivered to the ODS 180'. When the sensor 1410 detects the presence of a flame at the ODS 180', the sensor 1410 deactivates the igniter 1030.

Such an arrangement can ensure that any fuel delivered to the ODS 180' and/or to the burner 190' is ignited. Specifically, in the illustrated embodiment, the extension 1040 maintains continuous contact with the sensor 1032 of the igniter 1030 when the valve body 1124 is transitioned from the "off" configuration. When moved to the "manual" configuration, the valve body 1124 permits fuel to flow to the ODS 180' via the ODS outlet 1008 and permits fuel to flow to the burner 190' via the burner outlet 1010. Due to the repeated firing of the igniter 1030, fuel delivered to the ODS 180' will ignite and produce a pilot flame, which will combust any fuel delivered to the burner 190'. Such an arrangement can thus overcome certain drawbacks and limitations of prior art devices, as discussed above.

Figure 28:
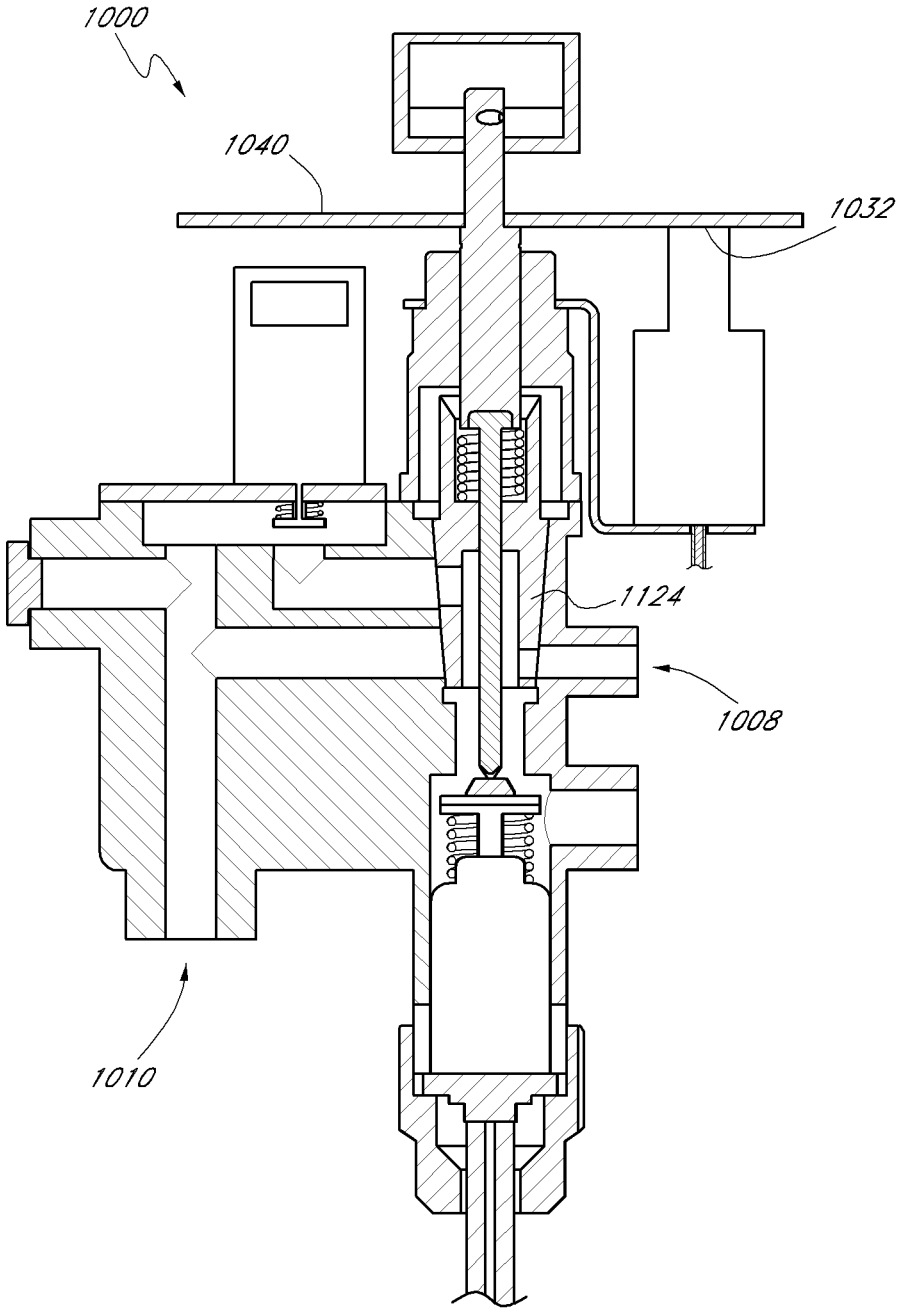
FIG. 28 is a cross-sectional view of an embodiment of the control valve assembly shown in an "automatic" configuration.

FIG. 28 illustrates the control valve assembly 1000 shown in FIG. 27 with the control valve assembly 1000 in the "automatic" configuration. As shown in the depicted embodiment, the extension 1040 contacts the sensor 1032 when the control valve is in the "automatic" configuration. Accordingly, the foregoing discussion with respect to the "manual" configuration applies to the depicted "automatic" configuration as well. For example, when moved to the "automatic" configuration, the valve body 1124 permits fuel to flow to the ODS 180' via the ODS outlet 1008 and permits fuel to flow to the burner 190' via the burner outlet 1010. Due to the repeated firing of the igniter 1030, fuel delivered to the ODS 180' will ignite and produce a pilot flame, which will combust any fuel delivered to the burner 190'.

Although particular embodiments of the control valve assembly 1000 have been described as including solenoid valves, other suitable valves may also be used. Such other suitable valves may comprise, for example, pneumatic valves, hydraulic valves or any other suitable valve.

Reference throughout this specification to "one embodiment" or "an embodiment" means that a particular feature, structure or characteristic described in connection with the embodiment is included in at least one embodiment. Thus, appearances of the phrases "in one embodiment" or "in an embodiment" in various places throughout this specification are not necessarily all referring to the same embodiment. Furthermore, the particular features, structures or characteristics of any embodiment described above may be combined in any suitable manner, as would be apparent to one of ordinary skill in the art from this disclosure, in one or more embodiments.

Similarly, it should be appreciated that in the above description of embodiments, various features of the inventions are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that any claim require more features than are expressly recited in that claim. Rather, as the following claims reflect, inventive aspects lie in a combination of fewer than all features of any single foregoing disclosed embodiment. Thus, the claims following the Detailed Description are hereby expressly incorporated into this Detailed Description, with each claim standing on its own as a separate embodiment.

What is claimed is:

1. A control valve assembly for use in a heater comprising:

a housing having an inlet, an oxygen depletion sensor (ODS) outlet, and a first burner outlet;

a valve body positioned within the housing and configured to rotate relative to the housing so as to selectively permit fuel to flow from the inlet to one or more of the outlets, the valve body having an OFF position, a Pilot Position, a Manual Position, and an Automatic position;

an igniter comprising a sensor, the igniter capable of repeatedly firing an electrode when the sensor is activated;

a shaft coupled to the valve body and configured to move the valve body between the OFF, Pilot, Manual, and Automatic positions;

an extension coupled with the shaft and extending radially outward therefrom and configured to activate the sensor and thereby to activate the igniter, wherein the extension is configured to contact the sensor and activate the igniter when the shaft is depressed regardless of whether the valve body is in any of the OFF, Pilot, Manual, and Automatic positions; and a solenoid valve configured to control fuel flow into the control valve assembly in response to an electrical input.

2. The control valve assembly of claim 1, wherein the sensor comprises a button sensitive to pressure actuation configured such that contact of the extension with the sensor results in multiple firings of the electrode.

3. The control valve assembly of claim 1, wherein the sensor comprises a magnetometer.

4. The control valve assembly of claim 1, wherein the extension is substantially disk-shaped.

5. The control valve assembly of claim 4, wherein the extension has a radius larger than the distance between an axial center of the shaft and the sensor of the igniter.

6. The control valve assembly of claim 5, further comprising a selector knob coupled with the shaft.

7. The control valve assembly of claim 6, wherein the extension is configured to contact the sensor and activate the igniter when the knob is depressed, regardless of the rotational orientation of the knob.

8. The control valve assembly of claim 6, further comprising a biasing member configured to bias the shaft and knob to an upward position away from the housing.

9. The control valve assembly of claim 1, further comprising a protrusion on the shaft and a plurality of recesses on the housing, the protrusion configured to fit within one of our recesses on the housing after the shaft and valve body have been rotated, each recess corresponding with one of the OFF position, Pilot Position, Manual Position, and Automatic position of the valve body.

10. The control valve assembly of claim 9, further comprising a stop configured to prevent rotation of the protrusion past the stop.

11. The control valve assembly of claim 1, further comprising the electrode, the electrode being electrically coupled to the igniter.

12. The control valve assembly of claim 11, wherein the electrode comprises a piezoelectric material.

13. The control valve assembly of claim 1, further comprising a thermocouple wherein the solenoid valve is coupled to the thermocouple.

14. The control valve assembly of claim 1, further comprising a second burner outlet.

15. The control valve assembly of claim 14, further comprising a plug positioned in one of the burner outlets.

16. The control valve assembly of claim 14, wherein the second burner outlet is positioned on the housing 90 degrees off set from the first burner outlet.

17. The control valve assembly of claim 1, further comprising a temperature regulator having a thermostat configured for regulating a fuel flow through the valve assembly based on a temperature outside of a heater.

18. The control valve assembly of claim 17, wherein the temperature regulator further comprises a battery.

19. The control valve assembly of claim 17, wherein the temperature regulator further comprises a power interface for coupling with a power source.

* * * * *

UNITED STATES PATENT AND TRADEMARK OFFICE

CERTIFICATE OF CORRECTION

PATENT NO. : 9,097,422 B2
APPLICATION NO. : 13/683855
DATED : August 4, 2015
INVENTOR(S) : David Deng It is certified that error appears in the above-identified patent and that said Letters Patent is hereby corrected as shown below:

In the claims,
In column 24 at line 43, In Claim 9, change “one of our” to --one of four--.

Signed and Sealed this
Twenty-third Day of February, 2016

Michelle K. Lee

Michelle K. Lee
*Director of the United States Patent and Trademark Office*